US009144779B2

(12) United States Patent
Summons et al.

(10) Patent No.: US 9,144,779 B2
(45) Date of Patent: Sep. 29, 2015

(54) SYSTEM FOR PROVIDING CUSTOM COLORED SEALING COMPOUND

(71) Applicant: Sascho, Inc., Brighton, CO (US)

(72) Inventors: Wayne Summons, Thornton, CO (US); Elliot Summons, Centennial, CO (US); Kenneth W. Atkinson, Thornton, CO (US); Daniel P. Lewis, Denver, CO (US); Scott G. Bohm, Thornton, CO (US); Mark Niiro, Highlands Ranch, CO (US); Jeremy Yunge, Evans, CO (US)

(73) Assignee: SASHCO, INC., Brighton, CO (US)

( * ) Notice: Subject to any disclaimer, the term of this patent is extended or adjusted under 35 U.S.C. 154(b) by 0 days.

(21) Appl. No.: 14/318,801

(22) Filed: Jun. 30, 2014

(65) Prior Publication Data

US 2014/0312068 A1 Oct. 23, 2014

Related U.S. Application Data

(63) Continuation of application No. 12/699,697, filed on Feb. 3, 2010, now Pat. No. 8,834,014, which is a continuation-in-part of application No. 12/410,301, filed on Mar. 24, 2009, now Pat. No. 8,100,296, which is a continuation of application No. 12/053,865, filed on Mar. 24, 2008.

(51) Int. Cl.

| | |
|---|---|
| ***B01F 15/00*** | (2006.01) |
| ***B01F 11/00*** | (2006.01) |
| ***B01F 15/02*** | (2006.01) |

(52) U.S. Cl.

CPC ..... *B01F 15/00753* (2013.01); *B01F 11/0002* (2013.01); *B01F 15/00766* (2013.01); *B01F 15/00831* (2013.01); *B01F 15/0203* (2013.01)

(58) Field of Classification Search

CPC ..... B01F 15/00753; B01F 15/00831; B01F 15/0203; B01F 15/00766; B01F 11/0002

USPC ..... 366/69, 96, 130, 208–219, 348, 349, 366/605; 494/82; 222/325–327, 94–95, 222/105; 206/219–222; 211/74

See application file for complete search history.

(56) References Cited

U.S. PATENT DOCUMENTS

| | | | | |
|---|---|---|---|---|
| 4,090,612 | A * | 5/1978 | Lostutter | 211/13.1 |
| 4,114,196 | A * | 9/1978 | Lostutter | 366/348 |
| D283,946 | S * | 5/1986 | Chase | D3/315 |
| 5,044,758 | A * | 9/1991 | Kurtz | 366/77 |
| 6,302,575 | B1 * | 10/2001 | Anderson et al. | 366/349 |
| 6,464,112 | B2 * | 10/2002 | Summons et al. | 222/327 |
| 6,709,148 | B2 * | 3/2004 | Glass | 366/110 |
| 6,832,797 | B1 * | 12/2004 | Gassel et al. | 294/143 |
| 6,910,799 | B2 * | 6/2005 | Renfro | 366/169.1 |

(Continued)

*Primary Examiner* — Charles Cooley

(74) *Attorney, Agent, or Firm* — Perkins Coie LLP

(57) ABSTRACT

A system and method for custom coloring sealant is generally provided with one or more dispensing cartridges, containing a quantity of low viscosity sealant base solution, which in some embodiments is as fluid, or more-so, as common latex paint. One or more such dispensing cartridges are secured within a cartridge case. A coloring agent is added to the dispensing cartridge. The system may then be agitated by hand or in a mechanical agitator, such as a commercial paint shaker, until a desired color is attained. The sealant thickener may then be added and mixed by similar agitation of the system to obtain a non-sag, high viscosity sealant. Embodiments of the cartridge case are provided for use with various mechanical agitators and dispensing cartridges.

11 Claims, 36 Drawing Sheets

(56) References Cited

U.S. PATENT DOCUMENTS

| | | | | |
|---|---|---|---|---|
| 7,070,318 | B2 * | 7/2006 | Renfro | 366/143 |
| 7,407,321 | B1 * | 8/2008 | Renfro | 366/256 |
| 7,527,421 | B2 * | 5/2009 | Anderson et al. | 366/69 |
| 7,798,363 | B2 * | 9/2010 | Brandon | 222/1 |
| 7,980,755 | B2 * | 7/2011 | Renfro | 366/255 |
| 8,100,296 | B2 * | 1/2012 | Summons et al. | 222/142.1 |
| 8,430,276 | B2 * | 4/2013 | Longo, II | 222/327 |
| 8,469,188 | B1 * | 6/2013 | Vitale | 206/277 |
| 8,485,379 | B2 * | 7/2013 | Huckby | 220/23.91 |
| 8,764,276 | B1 * | 7/2014 | Higbie et al. | 366/130 |
| 8,800,816 | B2 * | 8/2014 | Summons et al. | 222/129 |
| 8,834,014 | B2 * | 9/2014 | Summons et al. | 366/209 |
| 2002/0020718 | A1 * | 2/2002 | Summons et al. | 222/327 |
| 2002/0036952 | A1 * | 3/2002 | Anderson et al. | 366/348 |
| 2002/0065353 | A1 * | 5/2002 | Anderson et al. | 524/492 |
| 2002/0154568 | A1 * | 10/2002 | Renfro | 366/169.1 |
| 2004/0173640 | A1 * | 9/2004 | Brandon | 222/327 |
| 2006/0151531 | A1 * | 7/2006 | Tikusis | 222/145.6 |
| 2007/0109910 | A1 * | 5/2007 | Anderson et al. | 366/69 |
| 2007/0158370 | A1 * | 7/2007 | Longo | 222/327 |
| 2007/0242558 | A1 * | 10/2007 | Brandon | 366/143 |
| 2008/0044627 | A1 * | 2/2008 | Groseclose et al. | 428/144 |
| 2008/0160301 | A1 * | 7/2008 | Nandi et al. | 428/363 |
| 2009/0179050 | A1 * | 7/2009 | Anderson et al. | 222/327 |
| 2009/0236365 | A1 * | 9/2009 | Summons et al. | 222/129 |
| 2010/0018995 | A1 * | 1/2010 | Summons et al. | 222/129 |
| 2010/0135108 | A1 * | 6/2010 | Summons et al. | 366/208 |
| 2011/0174836 | A1 * | 7/2011 | Summons et al. | 222/129 |
| 2014/0312068 | A1 * | 10/2014 | Summons et al. | 222/144.5 |
| 2014/0319166 | A1 * | 10/2014 | Summons et al. | 222/1 |
| 2014/0332556 | A1 * | 11/2014 | Summons et al. | 222/80 |
| 2014/0332557 | A1 * | 11/2014 | Summons et al. | 222/80 |

* cited by examiner

SYSTEM FOR PROVIDING CUSTOM COLORED SEALING COMPOUND

CROSS-REFERENCE TO RELATED PATENT APPLICATIONS

This patent application is a continuation of U.S. patent application Ser. No. 12/699,697 entitled "System and Method of Providing Custom Colored Sealing Compound", filed on Feb. 3, 2010, now U.S. Pat. No. 8,834,014 which is a continuation-in-part of U.S. patent application Ser. No. 12/410,301, entitled "System and Method of Providing Individual Quantities of Custom Colored Sealing Compound," filed on Mar. 24, 2009, now U.S. Pat. No. 8,100,296, which is a continuation of U.S. patent application Ser. No. 12/053,865, entitled "System and Method of Providing Individual Quantities of Custom Colored Sealing Compound," filed on Mar. 24, 2008, the contents of which are hereby incorporated by reference herein in its entirety.

BACKGROUND

The construction and home improvement arts frequently need custom colored sealants for the improved aesthetic appearance of a wide array of projects. Common substrates where precisely color-matched caulks are needed and desired include: painted surfaces, stained surfaces, counter tops, wall paper, pre-colored siding materials, brick, stone, tile, bath and kitchen fixtures, flooring, etc. While some factory-tinted, non-custom colored caulks are available in the trade (with white being the overwhelmingly dominant color), most such colors of caulk do not match the substrates they are applied to very well.

At least one company has provided custom color-matching of individual containers of caulk. However, the custom color-matching has only been done by the company itself and only at its factory. Accordingly, such a custom-coloring service only works when: 1) the consumer or contractor is willing or able to wait several days or weeks for color submittals and then delivery from the factory; 2) the consumer is willing to purchase a relatively large volume of custom-colored caulk; and 3) the consumer is willing to pay a very high price for such factory-made custom colors of caulk.

Consumers and contractors, for example, have not been able to go to a local paint store and conveniently purchase quantities of paint or stain and custom tinted containers of sealant at the same time. In particular, the long-standing and unmet need in the market has centered around the ability to: easily custom tint small or large quantities of cartridges or squeeze tubes or small-bulk packages of sealant at a time, with no mess; acquire custom tinted sealant at a low-to-moderate cost; and custom tint sealant without waiting for extended periods of time. To date, these aggregate criteria have been heretofore unavailable.

Some of the key difficulties that have prevented the resolution of such problems in the prior art have centered on several issues. For example, the high viscosity of typical sealant products has made it very difficult or impossible to easily and uniformly mix liquid or dry colorants throughout the sealant. In contrast with this problem, adding and mixing liquid or dry colorants into products with much lower viscosities, such as latex paint, has been relatively easy. The basic elongated geometry of standard sealant containers, which produces a high aspect-ratio container, presents another difficulty to overcome. Colorants that are introduced into one end of such elongated containers are difficult to uniformly distribute throughout the entire length of the containers.

Moreover, most systems require that the containers of sealant be mixed one at a time, which can waste valuable time while attempting to complete jobs.

Several approaches have either been proposed or commercially attempted previously to allegedly allow for an easy, fast, convenient, mess-free, and inexpensive method for the custom-coloring of individual containers of caulk at or near the location in the field where the caulk is to be used. While some of the approaches taken have delivered a low level of partial success at in-the-field custom coloring of caulk in individual rigid caulk cartridges, none have provided the needed ease of mixing and dispensing, no mess, no loss of product, economy, speed, and ability to simultaneously mix several containers of sealant at once. Moreover, none of the prior attempts have made it possible to custom tint small or large numbers of flexible squeeze tubes or small-bulk packages of caulk, leaving a great unmet need in the art.

SUMMARY

This Summary is provided to introduce a selection of concepts in a simplified form that are further described below in the Detailed Description. This Summary, and the foregoing Background, is not intended to identify key aspects or essential aspects of the claimed subject matter. Moreover, this Summary is not intended for use as an aid in determining the scope of the claimed subject matter.

The system for custom coloring sealant is provided with one or more dispensing cartridges, such as rigid cylindrical caulk cartridges, flexible squeeze tubes, and the like. The dispensing cartridges are at least partially filled with a very low viscosity sealant base solution. The sealant base solution, when properly formulated for appropriate thickening, can be comprised of any suitable chemical type, such as acrylic latex, vinyl latex, silicone, polyurethane, etc. In at least one embodiment, the viscosity of the sealant base solution is in the range of 50 to 100,000 centipoise at low shear rates. The first open end portion 14 of the dispensing cartridges are provided with a selectively removable cap, rather than a fixed dispensing nozzle. In various embodiments, dispensing nozzles are secured in place of the cap, after the mixing is done, to apply the colored and thickened sealant to the substrate.

The system will typically include a quantity of at least one coloring agent. The coloring agent may include liquid pigments, dry pigments, latex paint or latex stain. Such coloring agents will mix quickly and easily with the low viscosity sealant base solution, thus permitting mixing by hand agitation or a variety of different methods of mechanical agitation. Examples of sealant thickeners suitable for producing non-sag caulk viscosity, when such agents are introduced into the sealant base solution, include, but are not in any way limited to: ammonium hydroxide, sodium hydroxide, potassium hydroxide, 2-amino methyl propanol, Acrysol ASE-60, Acrysol SCT-275, Acrysol RM-2020, Acrysol RM-825, Carbopol Aqua SF-1, Polyphobe 106HE, Tafigel PUR-61, Methocel, Bermocoll, Tylose, Rheolate 1, Rheolate 425, etc. Hand or mechanical agitation may be used to mix the sealant thickener with the sealant base solution and the coloring agent.

Various embodiments of the system will include the use of a cartridge case to assist in the agitation of one or more dispensing cartridges. In some embodiments, the cartridge case will be provided to have a first end portion and an opposite second end portion that are operatively coupled with one another. Such an operative coupling may include the physical coupling of separate end portions and may include a cartridge case formed from a uniform construction, simply having opposite first and second end portions. The first and second end portions are formed to have a plurality of cavities that are in open communication with one another to receive at least end portions of one or more dispensing cartridges. The cavities define cartridge receptacles that are shaped to releasably secure dispensing cartridges in a mixing position within the cartridge case.

Other embodiments of the cartridge case are provided in a uniform construction, whereby the first end portion and second end portion are operatively coupled with one another through at least one sidewall that extends therebetween. Some embodiments of the system operatively couple generally planar first and second end portions of the cartridge case by a plurality of elongated frame members that extend therebetween.

Certain uses of the system will provide a greater number of cartridge receptacles within the cartridge case than the total number of dispensing cartridges to be used. In such situations, one or more weights may be used that are shaped and weighted similarly to the dispensing cartridges being used. In this manner, the mass supported within the cartridge case may be evenly distributed to provide a balanced load during agitation or other maneuvering of the cartridge case when it is loaded.

Various embodiments of the technology will be provided with an end cap that may be selectively secured with the first end portion of the cartridge case in a manner that retains the one or more dispensing cartridges within the cartridge receptacles when the dispensing cartridges are in the mixing position. A lower surface of the end cap may be provided with a plurality of cavities that align with the cartridge receptacles when the end cap is aligned with the cartridge case in a mixing position. In some embodiments, openings pass from the ends of the cavities through the top end portion or surface of the end cap and provided with a diameter sufficient that the caps positioned on the threaded nubs of the dispensing cartridges are accessible to be removed from or inserted onto the threaded nubs.

Some embodiments of the system may employ a flexible end cap, formed from one or more of a variety of flexible materials. The flexible end cap will be provided with a plurality of cap openings that are shaped to permit the caps of the dispensing cartridges to pass therethrough. Mechanical fasteners, such as elongated straps with hook and loop fastening material, may be used to secure the flexible end cap with the first end portion of the cartridge case, such that the flexible end cap is positioned in a spaced-apart relationship with the second end portion of the cartridge case. Where a rigid end cap is used with the system, one or more locking pins may be provided to extend from the end cap in positions to be received by one or more sockets that extend into the second end portion of the cartridge case, while maintaining a spaced-apart relationship between the portions of the cartridge case.

Several embodiments of the system will be provided with a cartridge case having one or more cartridge receptacles, having a circular cross-section, other shapes are contemplated, such as cartridge receptacles formed, at least in part, with a generally rectangular cross-section, and tapered volumes over a length of the cartridge receptacles, whereby generally tapered, sealant squeeze tubes may fit within the cartridge receptacles. Other cross-sectional shapes and volumes are contemplated to receive various types of dispensing cartridges.

Various methods of agitating the cartridge case may cause the dispensing cartridges to rotate within the cartridge receptacles, which will be counterproductive to a mixing or agitating movement. Accordingly, various anti-rotation elements may be incorporated into the system. In some embodiments, a notch may be formed in the second end portion of the dispensing cartridge and a projection or tooth formed in the cartridge receptacles, adjacent the first end portion of the cartridge case. The tooth should be shaped and positioned to be at least partially disposed within the notch when the dispensing cartridge is placed in the mixing position, whereby the dispensing cartridge is prevented from rotating about a long axis with respect to the cartridge case. Other anti-rotational embodiments are contemplated.

Various dispensing cartridges, such as rigid caulking tubes, use a plunger that is axially, slidably disposed within the dispensing cartridge, adjacent the second end portion. Accordingly, a positive stop may be provided to prevent the plunger from unintentionally exiting through the second end portion of the dispensing cartridge. In some embodiments, a lip member extends radially inwardly from the second end portion of the dispensing cartridge. In other embodiments, at least one barb may be provided to extend radially inwardly from the second end portion of the dispensing cartridge. In still other embodiments, the second end portion of the dispensing cartridge may be tapered inwardly to a terminal diameter that is less than a diameter of the plunger.

Various embodiments for the methodology used to custom color sealant, according to the present technology, will not vary greatly, irrespective of the type of dispensing cartridges or cartridge case being used. In particular, a plurality of dispensing cartridges will be provided with a quantity of sealant base solution. The dispensing cartridges will be secured within the cartridge receptacles of a cartridge case. With the caps removed from the dispensing cartridges, a quantity of one or more coloring agents will be introduced to the interior compartment of the dispensing cartridges. The caps will then be resecured with the dispensing cartridges and the cartridge case may be agitated. The agitation step may be performed by hand or with a mechanical agitator. A quantity of sealant thickener may then be introduced to the interior compartment of the dispensing cartridges. The cartridge case should then be agitated again in a manner similar to that used for incorporating the coloring agent. To assist in the step of agitating the cartridge case, an agitating device may be used. Examples of suitable agitating devices include oscillating shakers, vortex rotational mixers, gyroscopic rotational mixers, elliptical-orbit shakers, and the like.

These and other aspects of the present system and method will be apparent after consideration of the Detailed Description and Figures herein.

DRAWINGS

Non-limiting and non-exhaustive embodiments of the present invention, including the preferred embodiment, are described with reference to the following figures, wherein like reference numerals refer to like parts throughout the various views unless otherwise specified.

DETAILED DESCRIPTION

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense.

Figure 1:
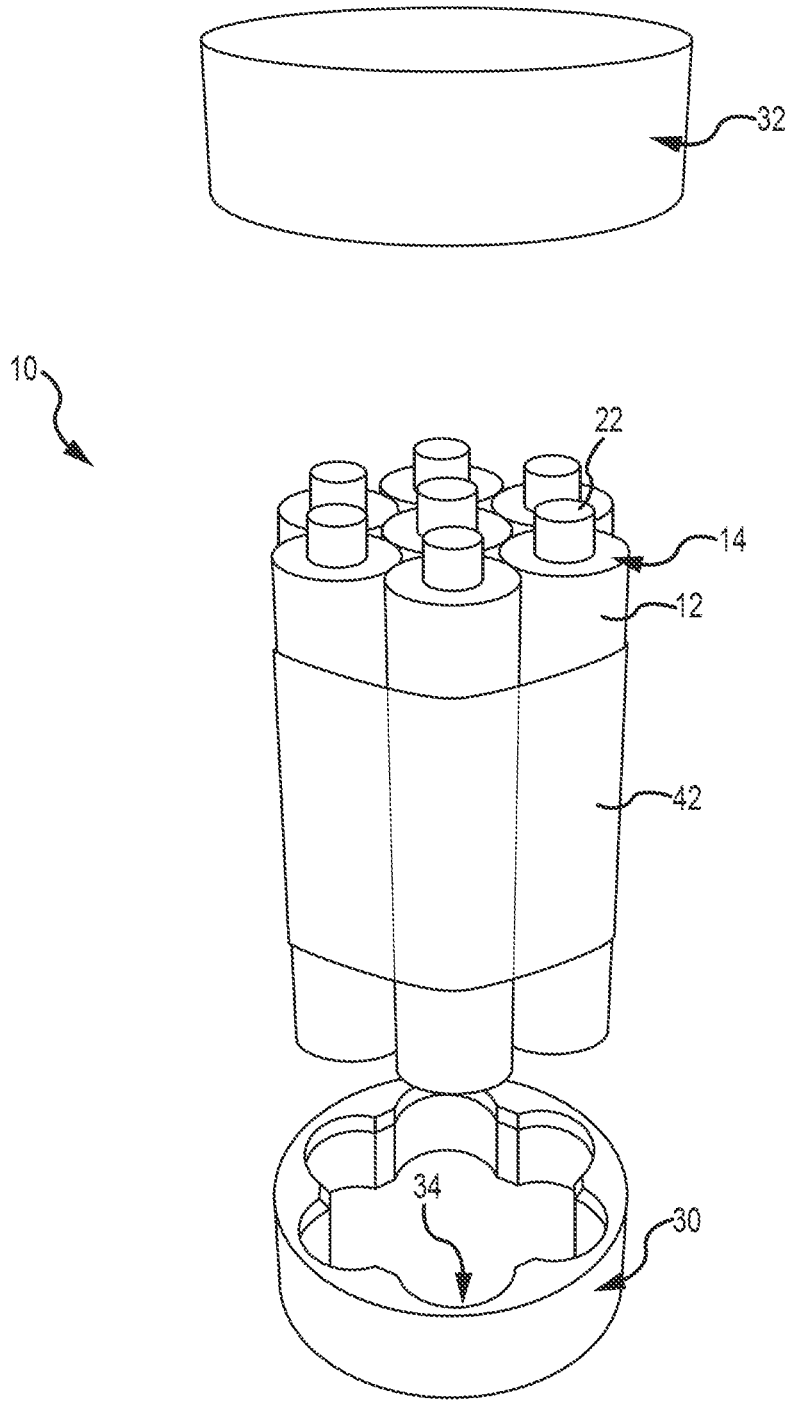
FIG. 1 depicts a partially exploded, isometric view of one embodiment of the system for providing custom colored sealing materials.
Figure 17:
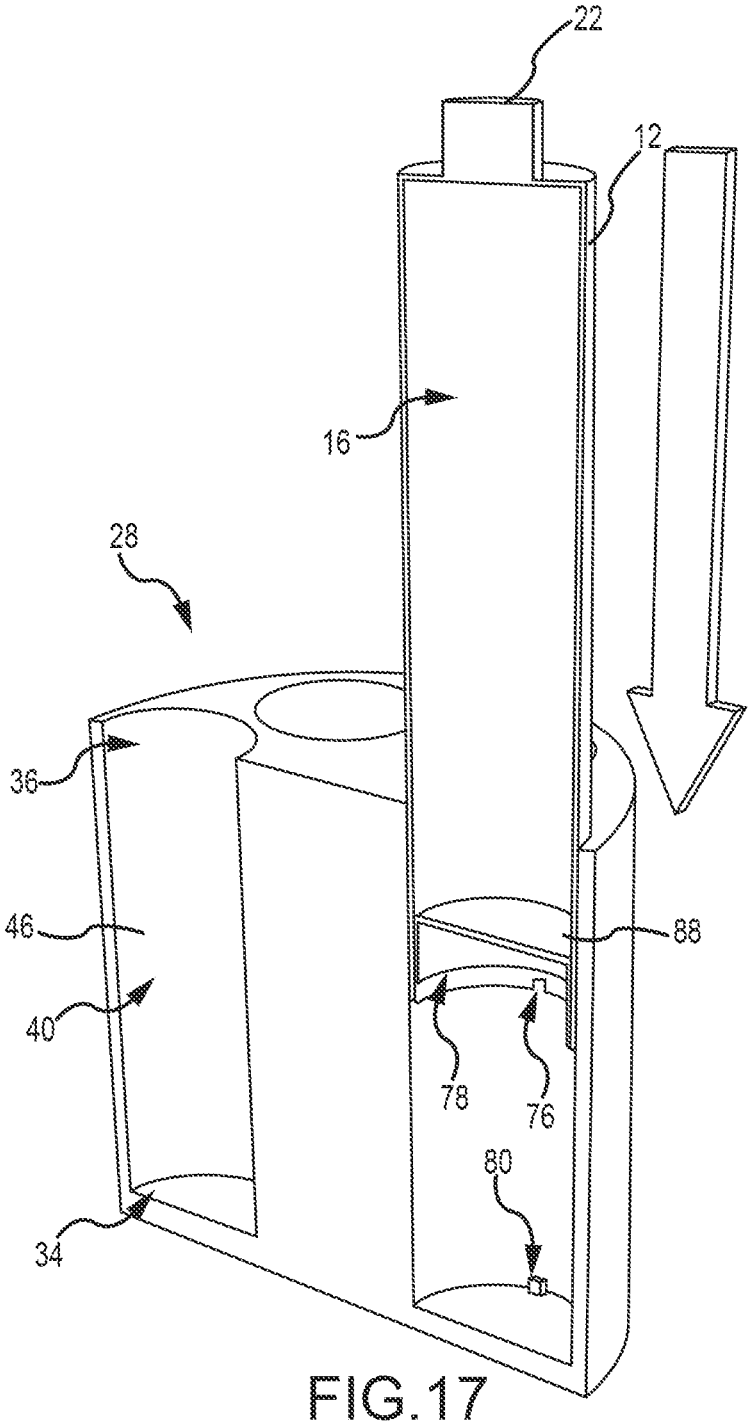
FIG. 17 depicts a cut away, isometric view of one embodiment of the system for providing custom colored sealing materials as the same may be provided to inhibit rotation of dispensing cartridges within a cartridge case.

With reference to FIG. 1, the system 10 for custom coloring sealant may be provided with dispensing cartridge 12, which may take the form of a rigid cylindrical caulk cartridge, flexible squeeze tube, bulk container, and the like. The dispensing cartridge 12 will generally have a first open end portion 14 that is in open fluid communication with an open interior compartment 16 (such as depicted in FIG. 17). In one aspect, the interior compartment 16 of the dispensing cartridge 12 will be at least partially filled at the factory with a very low viscosity sealant base solution 18 (such as depicted in FIG. 17).

Liquid latex caulk base is an example of a sealant base solution 18 that may be used with the system 10. In one aspect, the sealant base solution 18 liquid latex caulk base is formulated to a bluish or purplish shade. When the sealant cures, it presents a "water-clear" appearance (similar to a pool of clean water) with a blue to purple cast in order to enhance the "cleanness" of the ultimate color achieved by the end user by counteracting any undesirable amber or yellowish tones that can frequently occur otherwise when some sealants are formulated to cure to a "clear" appearance. In at least one embodiment, the viscosity of the sealant base solution is in the range of 50 to 100,000 centipoise at low shear rates, but in all cases, is of a sufficiently low viscosity to make mixing of coloring agents or texturizing agents into the sealant base very easy and fast, either by hand agitation or machine agitation. Such levels of viscosity greatly assist in making hand-mixing readily doable of the sealant base solution 18 with liquid or dry colorant that is added to the dispensing cartridge. In one aspect, the aforedescribed viscosity range is at least an order of magnitude lower than a common viscosity range of non-sag caulk bases used in the art. An example of "non-sag", with respect to a sealant such as caulk, is demonstrated when the sealant is applied to a vertical joint and does not flow downward by a distance of 2 mm or more. Testing for such "non-sag" standards may be done using a jig, such as the Frazier Flow Test Jig by Boeing.

In at least one embodiment, the first open end portion 14 of the dispensing cartridge 12 is provided with a hollow, threaded nub 20. In one aspect, the diameter of the threaded nub 20 may be provided to be at least ⅝", which provides approximately 56.3% more flow area than standard ½" diameter ports found on common caulk cartridges. Moreover, an enlarged diameter provides greater ease of access for materials that are to be added to the dispensing cartridge 12. It is contemplated, however, that a wide array of different diameters may be used to form the threaded nub 20.

A cap 22 may be removably coupled with the first open end portion 14 of the dispensing cartridge 12. In one embodiment, the cap 22 may be provided with mating threads that are shaped to operatively engage the threaded nub 20. The cap 22 will provide a measure of containment and protection to the contents of the dispensing cartridge during transport, agitation, and storage of the system 10. As such, the cap 22 may be used between uses of the system 10 after the sealant has been custom colored and thickened. Similarly, the system 10 may be provided with one or more removable seals that may be secured across the first open end portion 14 of the dispensing cartridge 12. Such seals may be secured with the system 10 prior to initial transport and storage of the system 10 in order to contain and protect the contents of the dispensing cartridge 12. It is contemplated that various paper, plastic and foil materials may be used when forming the seals. However, such materials may vary according to the circumstances and intended use of the system 10.

The system 10 should be provided with a quantity of at least one coloring agent 24. In one aspect, multiple coloring agents 24 may be provided. It is contemplated that the coloring agent may take many different forms. For example, the coloring agent 24 may be comprised of liquid pigments, dry pigments, latex paint or latex stain. Such coloring agents will mix quickly and easily with the sealant base solution, with minimal to moderate agitation of the components, due to its low viscosity. As such, it is contemplated that hand agitation, such as by shaking or hand mixing or a variety of different methods of mechanical agitation, will suffice for mixing the sealant base solution 18 with the coloring agent 24. In various embodiments, the means of transferring coloring agent 24 from its point of origin to the interior of container 12 may be a cup, syringe, pipette or other suitable transfer device.

Examples of sealant thickeners suitable for producing non-sag caulk viscosity, when such agents are introduced into the sealant base solution 18 described above, include, but are not in any way limited to: ammonium hydroxide, sodium hydroxide, potassium hydroxide, 2-amino methyl propanol, Acrysol ASE-60, Acrysol SCT-275, Acrysol RM-2020, Acrysol RM-825, Carbopol Aqua SF-1, Polyphobe 106HE, Tafigel PUR-61, Methocel, Bermocoll, Tylose, Rheolate 1, Rheolate 425, etc.

In at least one embodiment, a representative formula for a generalized low-viscosity sealant base solution described above (with many possible variations from this example also being possible), is as follows:

| | | |
|---|---|---|
| Rhoplex 2620 | 84.16% | Acrylic latex emulsion |
| T-Det N-407 | 0.18% | Surfactant |
| Water | 3.35% | Solvent |
| Mergal 395 | 0.14% | Biocide |
| Ethylene Glycol | 0.92% | Anti-freeze agent |
| 100LV Light Base Oil | 8.21% | Plasticizer |
| Ammonium Hydroxide 26BE | 0.25% | pH adjuster |
| Polyphase 678 | 0.10% | Biocide |
| Silquest A-1106 | 0.18% | Adhesion promoter |
| Zinplex 15 | 2.48% | Cross-linking agent |
| Violet dye/IPA solution | 0.05% | Yellow-neutralizing dying agent |
| Total> | 100.0% | |

Physical properties of the above sealant base solution include:

| | |
|---|---|
| Density> | 8.66 lbs/gallon |
| pH> | 7.11 |
| Viscosity> | 7,000 centipoise (Brookfield, #63 spindle @ 3 rpm) |
| Percent solids> | 59.57% |
| VOC content> | 26.69 grams/liter |

It must be understood, however, that the examples of thickening agents and sealant base solutions disclosed above are merely representative of a virtually infinite number of variations in raw materials and formula-proportions that could yield a similar final result for one skilled in the art of formulating sealants. For example, while the above sealant base solution is founded on the use of an acrylic latex emulsion polymer (Rhoplex 2620), the following polymer emulsion types could, without limitation, also be used to a similar effect: styrene-acrylic polymers, ethylene-vinyl acetate polymers, styrene-butadiene polymers, urethane polymers, acrylic-urethane polymers, vinyl acetate polymers, butyl polymers, and the like. It is also possible to formulate low viscosity sealant base solutions that can be thickened after being colored or texturized that are based on silicone, polyurethane, MS-Polymer, SPUR or other polymer types, without limitation. Similar variations, without limitation, are equally possible for such formula-dependent raw materials as: surfactants, biocides, anti-freeze agents, plasticizers, pH control agents, adhesion promoters, cross-linking agents, dying agents, texturizing agents, solvents, matting agents, etc.

Moreover, it is contemplated that the term "sealant", as used herein, may be applicable to a wide array of substances other than caulking and chinking materials. To be sure, the system 10 is applicable to "sealants" that may include forms of food products that employ one or more colors, such as icing used to cover cakes, pastries, and other foods. Such food products may be provided in the form of a "sealant base" that includes a liquid portion of the food product that first receives the coloring agent and, thereafter, a thickening agent. Examples of such sealant bases may include water, liquid dairy products, and other fluid solutions. "Coloring agents" may include various inks, dyes, and the like in various liquid and particulate forms. Examples of some "thickeners" may include particulate materials, such as various sugars, gelatins, flour, starches and the like, but may also include solids and semi-solids such as butter and shortening.

Various embodiments of the system 10 will include the use of a cartridge case 28 to assist in the agitation of one or more dispensing cartridges 12. It is contemplated that the cartridge case 28 may be provided in a wide array of configurations and formed from many different types of materials. The cartridge case 28 will provide the ability to agitate a plurality of dispensing cartridges 12 at once, whether the agitation is produced manually or through an automated agitation device. Accordingly, the following examples are not meant to be restrictive but, rather, illustrative of various different embodiments.

Figure 2:
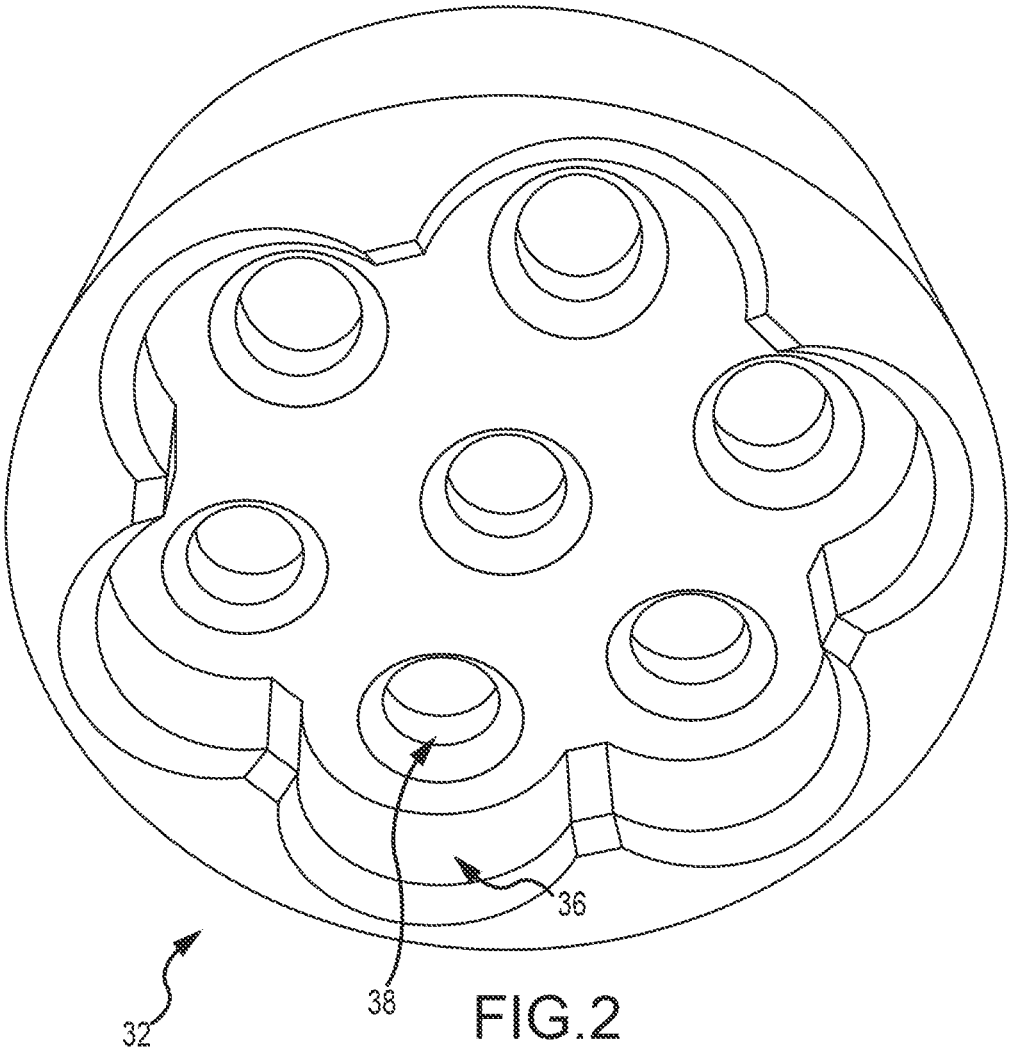
FIG. 2 depicts an isometric view of one embodiment of a first end portion to a cartridge case of the system for providing custom colored sealing materials.
Figure 3:
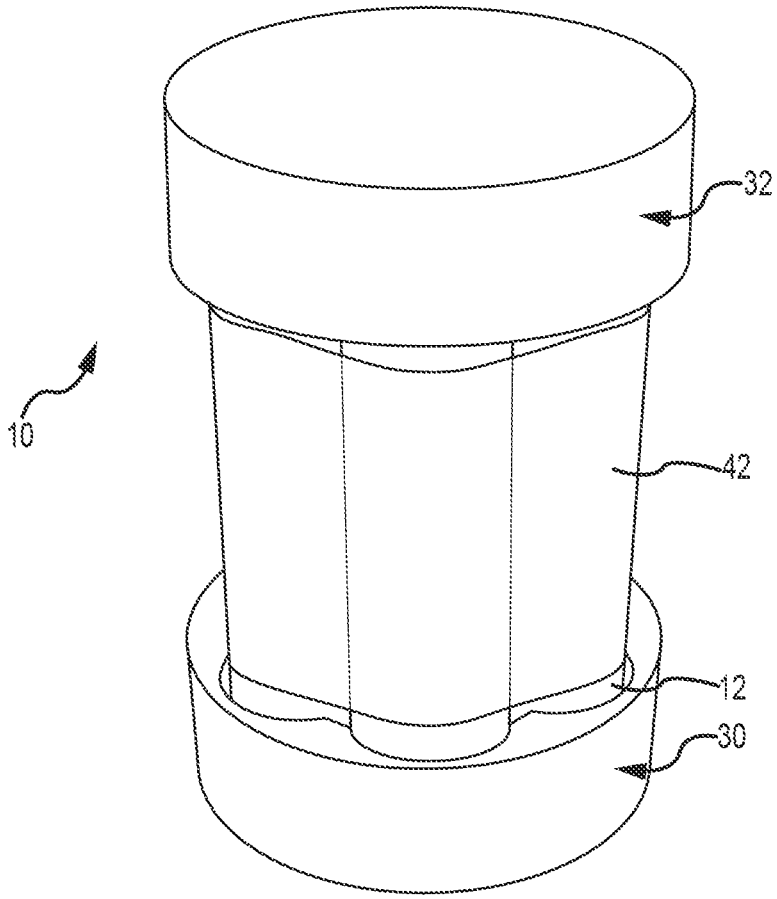
FIG. 3 depicts an isometric view of the system for providing custom colored sealing materials of FIG. 1 in an assembled, or mixing, position.

In some embodiments, the cartridge case will be provided to have a first end portion 30 and an opposite second end portion 32 that are operatively coupled with one another. Such an operative coupling may include the physical coupling of separate end portions and may include a cartridge case 28 formed from a uniform construction, simply having opposite first and second end portions 30 and 32. It is also contemplated, however, that the operative coupling of the first and second end portions may include the use of separate end portions that merely combine with one another to define a first end portion 30 and second end portion 32 of the cartridge case 28. With reference to FIGS. 1-6, examples of such cartridge cases 28 are depicted. FIGS. 1-3 illustrate one embodiment of a cartridge case 28 wherein the first end portion 30 includes at least one cavity 34 that is shaped to receive at least a portion of the dispensing cartridge 12. The embodiment depicted illustrates a plurality of cavities 34 that are in open communication with one another to form a star or flower shaped cavity that is shaped to releasably receive at least a portion of a plurality of dispensing cartridges 12 simultaneously. FIG. 2 depicts an exemplary embodiment of a separate second end portion 32 of the cartridge case 28, wherein the second end portion 32 is formed to have a plurality of cavities 36 that are formed in open communication with one another to receive at least a portion of one or more dispensing cartridges 12. The second end portion 32 is further provided with recesses 38 that are formed at the distal ends of the cavities 36. When the first end portion 30 and the second end portion 32 are aligned with one another, the cavities 34 and cavities 36 define cartridge receptacles 40 that are shaped to releasably secure dispensing cartridges 12 in a mixing position. In the mixing position, the recesses 38 at the distal ends of the cavities 36 are shaped to securely receive the caps 22 disposed at the first end portions 14 of the dispensing cartridges 12. Accordingly, it can be seen that lateral movement of the dispensing cartridges 12 is significantly limited when the first end portion 30 and second end portion 32 of the cartridge case 28 are operatively coupled with one another at opposite ends of the dispensing cartridges 12. It is contemplated that, for additional stability, a wrap 42 may be provided that extends around the exterior circumference of the collective dispensing cartridges 12. It is contemplated that the wrap 42 may be provided from a number of rigid and flexible materials. Those flexible materials that are resiliently deformable may provide an additional level of compression to reduce the likelihood of shift between the dispensing cartridges 12 as they are placed within, and removed from, the cartridge case 28.

Figure 4:
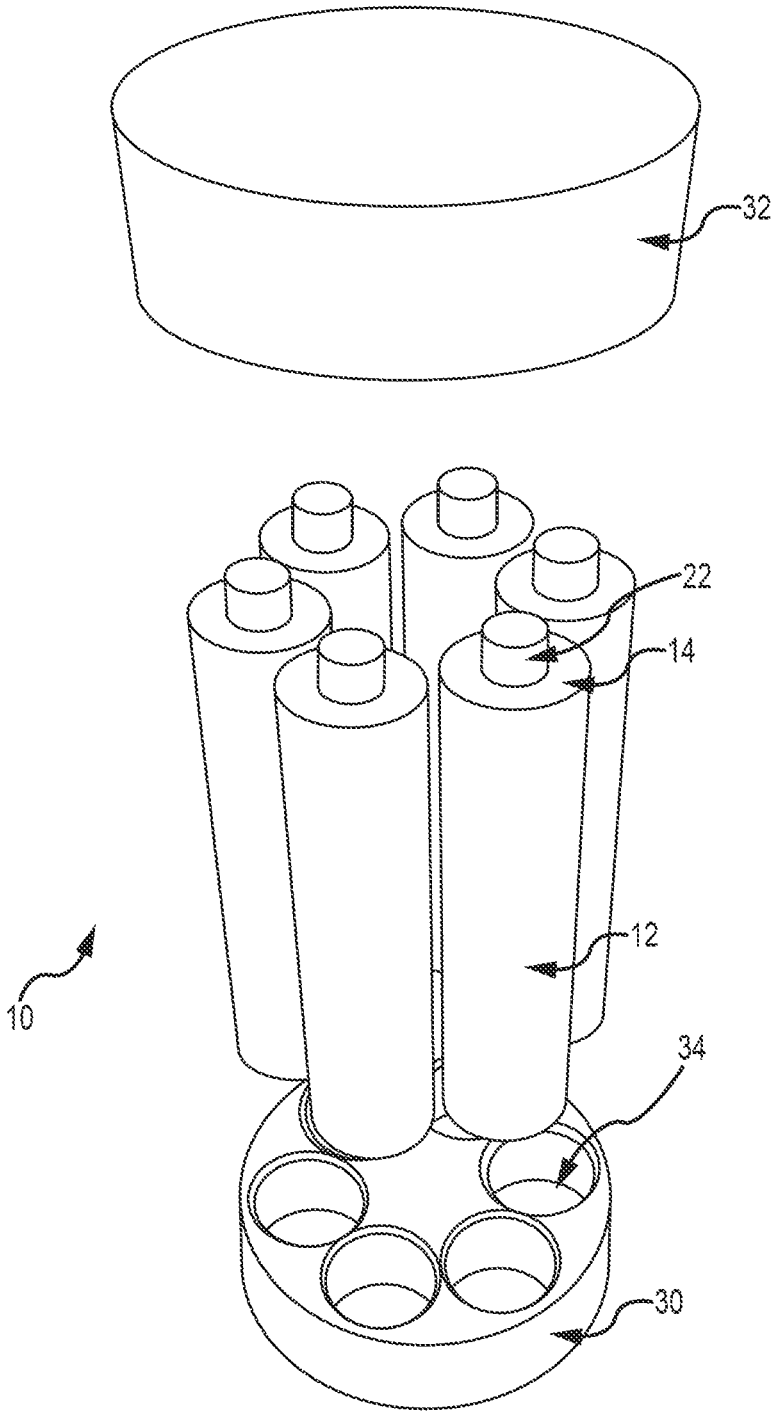
FIG. 4 depicts a partially exploded, isometric view of another embodiment of the system for providing custom colored sealing materials.
Figure 5:
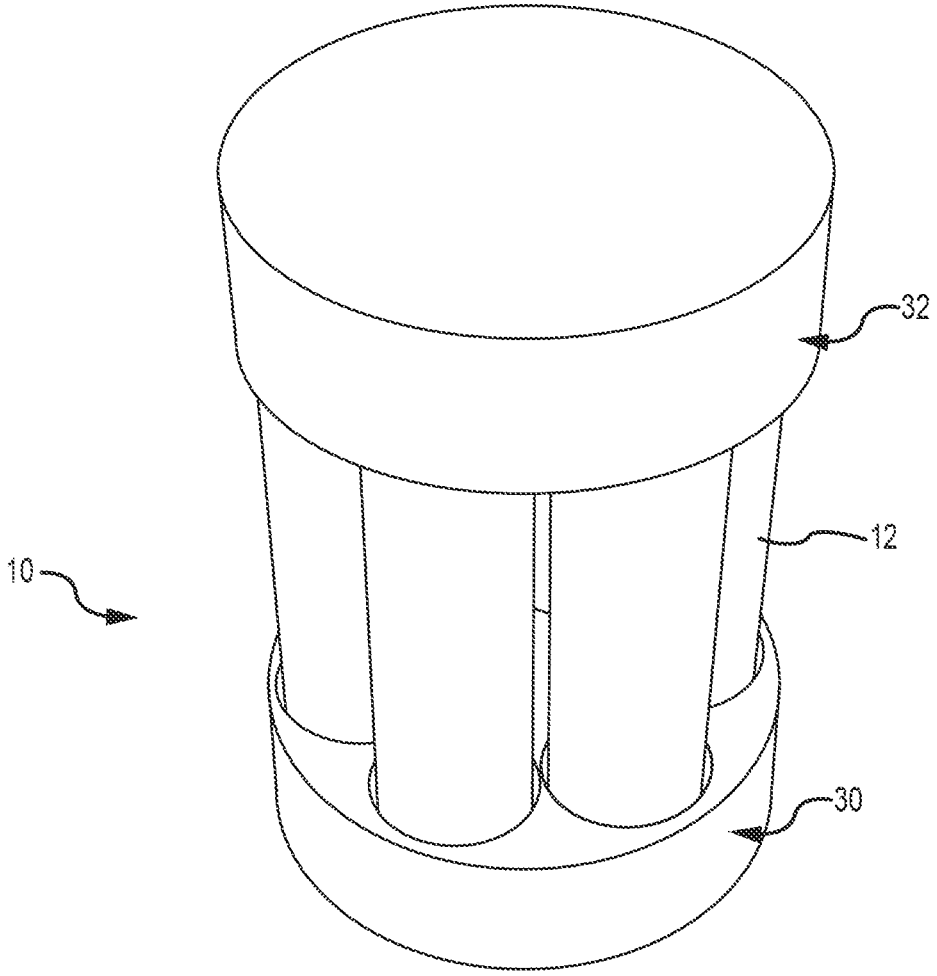
FIG. 5 depicts an isometric view of the system for providing custom colored sealing materials depicted in FIG. 4 in an assembled, or mixing, orientation.

With reference to FIGS. 4 and 5, some embodiments of the cartridge case 28 may be provided such that the cavities 34 and 36 may be formed to define separate, spaced-apart cavities that receive end portions of the dispensing cartridges 12. In a mixing position, such as depicted in FIG. 5, the first end portion 30 and second end portion 32 of the cartridge case 28 are positioned in a spaced apart relationship with one another, with no intervening elements therebetween. Accordingly, the first end portion 30 and second end portion 32 of the cartridge case 28 are in contact with, and supported by, the first and second end portions of a plurality of dispensing cartridges 12, when the cartridge case 28 is in the mixing position. The exemplary embodiment depicted in FIG. 4 illustrates a first end portion 30 having six separate cavities 34. It is contemplated that a greater or lesser number of cavities may be formed within both the first end portion 30 and the second end portion 34. It is contemplated that by forming individual cavities 34 and 36, that a wrap 42 may be unnecessary to stabilize a plurality of dispensing cartridges 12 disposed between the first end portion 30 and the second end portion 32 of the cartridge case 28.

Figure 6:
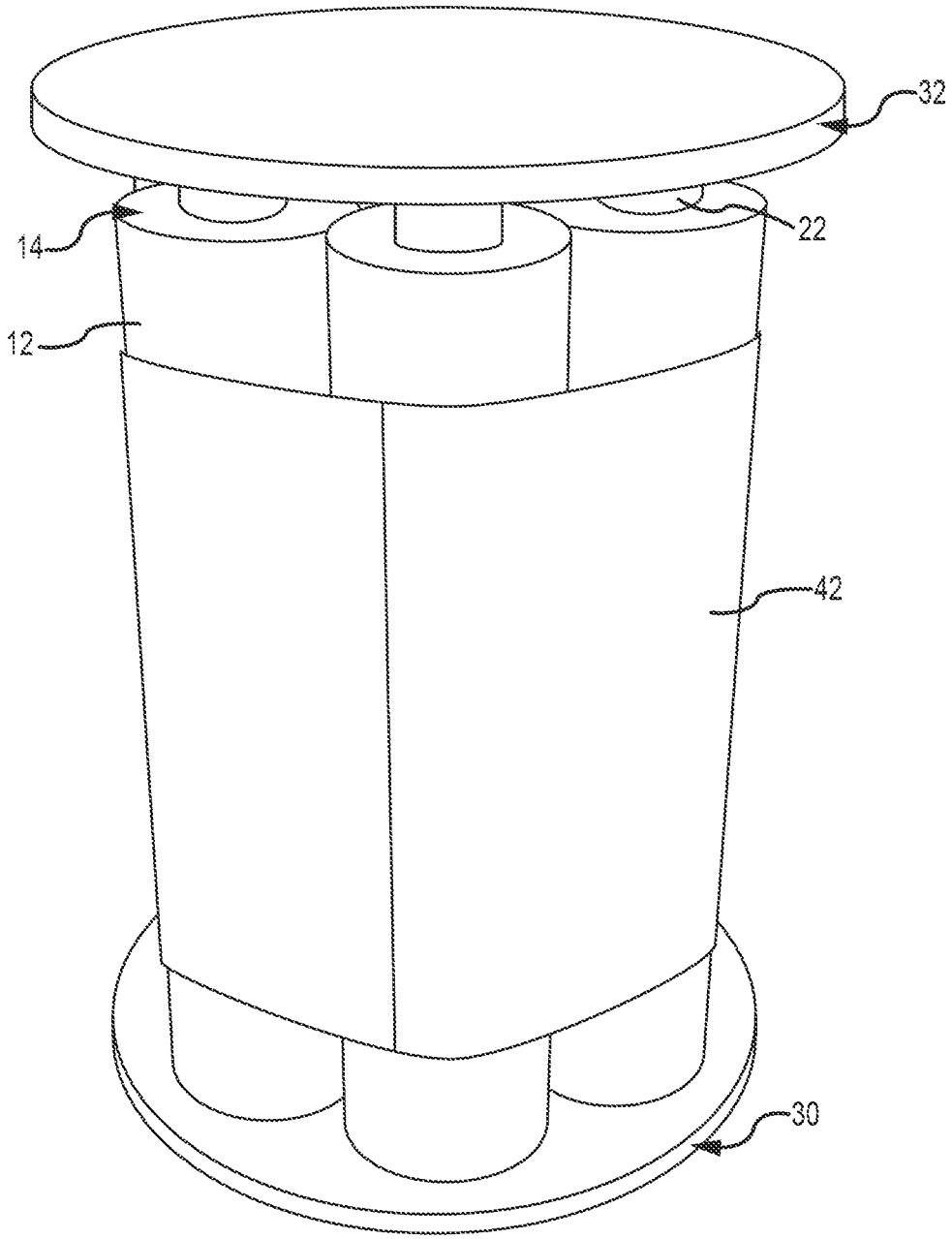
FIG. 6 depicts an isometric view of still another system for providing custom colored sealing materials in an assembled, or mixing, orientation.

With reference to FIG. 6, it is contemplated that the first end portion 30 and second end portion 32 may be provided in the form of generally planar elements formed from a resiliently deformable material, such as various foams, rubber materials, and the like. In such instances, compression on either end of the first end portion 30 and second end portion 32 will form the cavities 34 and 36 against a plurality of dispensing cartridges 12 positioned therebetween. In such instances, a wrap 42 may be advisable to maintain lateral stability of the dispensing cartridges 12 as they are positioned between the first end portion 30 and second end portion 32.

Figure 7:
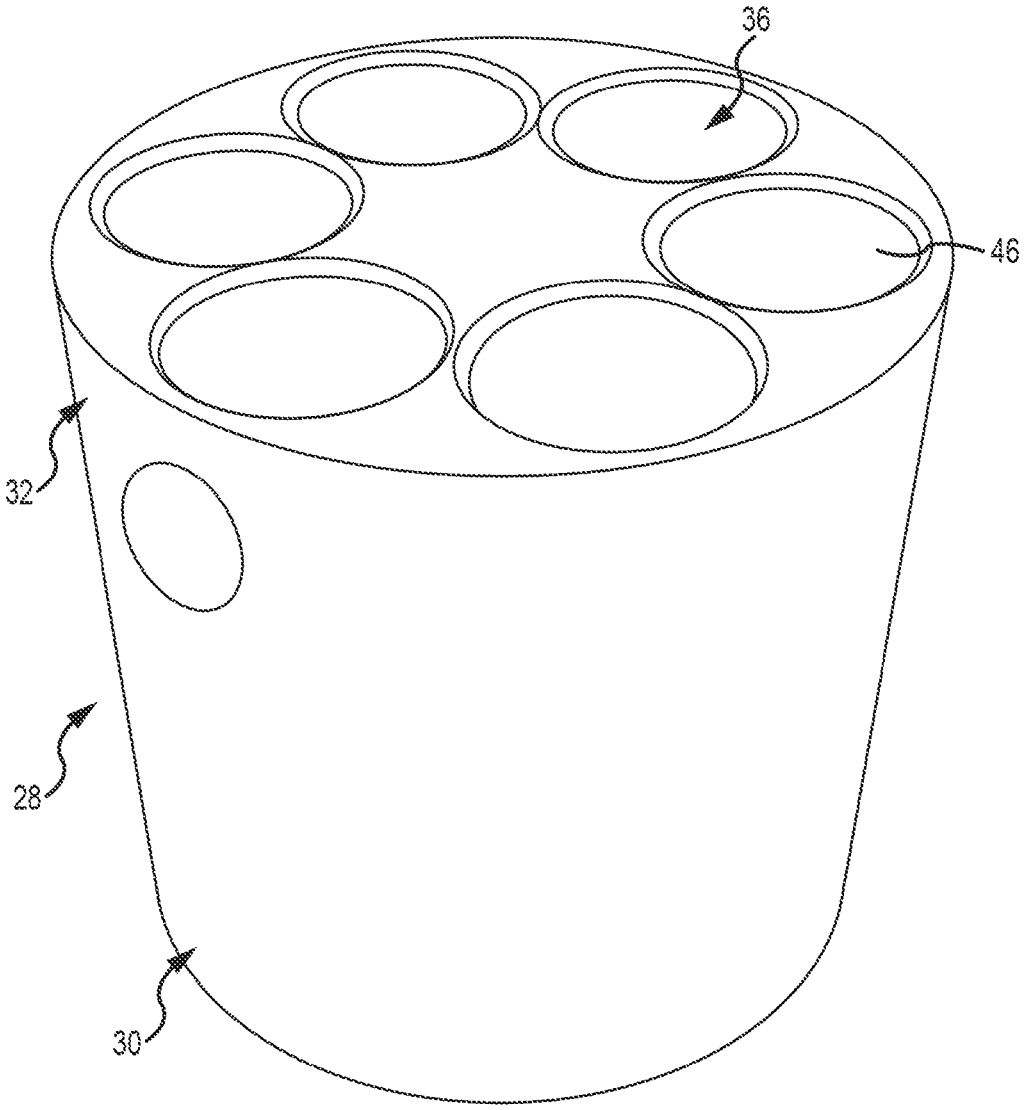
FIG. 7 depicts an isometric view of one embodiment of a cartridge case that may be used with the system for providing custom colored sealing materials.
Figure 8:
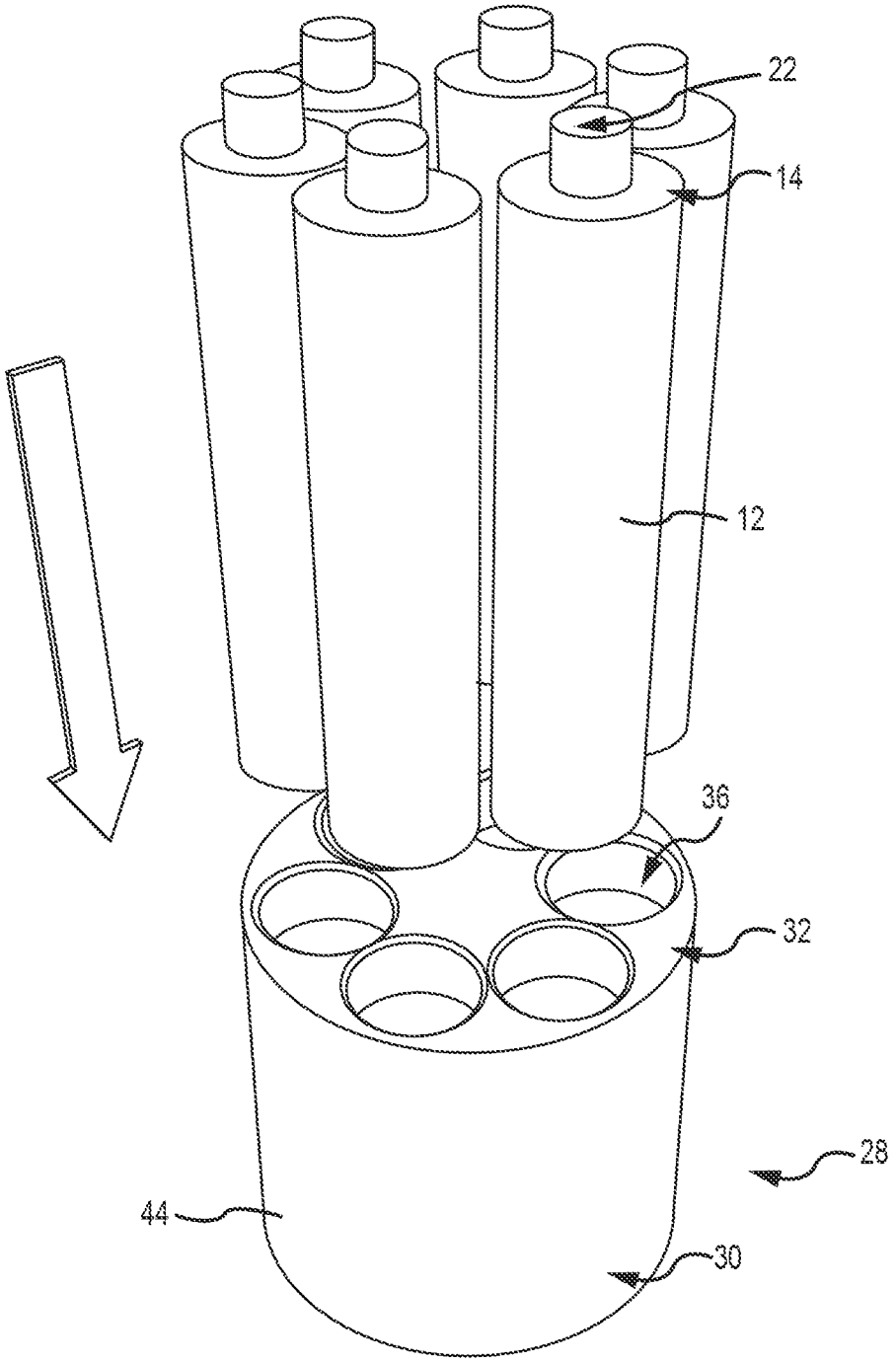
FIG. 8 depicts a partially exploded, isometric view of an embodiment of the system for providing custom colored sealing materials as the same may be used with rigid dispensing cartridges and the cartridge case depicted in FIG. 7.

With reference to FIGS. 7 and 8, other embodiments of the cartridge case 28 are provided in a uniform construction, whereby the first end portion 30 and second end portion 32 are operatively coupled with one another through at least one sidewall 44 that extends therebetween. In the example depicted in FIG. 7, the sidewall 44 is annular in nature and defines an outer circumference of the cartridge case 28. In such embodiments, the cartridge receptacles 40 are defined by the opposing cavities 34 and 36, which are coupled with one another through sleeves 46 that extend therebetween. It is contemplated that the construction of such cartridge case embodiments may be through molding or through the removal of portions of a single piece of material. Accordingly, it is contemplated that a wide array of materials, including various metals, plastics, and the like, may be used to form the cartridge case 28.

With reference to FIGS. 9-13, other embodiments of the cartridge case 28 may be formed in a uniform construction, whereby the first end portion 30 and second end portion 32 are operatively coupled with one another through a sidewall 48 that is not annular in nature but rather defines an exterior surface of both the cartridge case 28 and a portion of one or more of the sleeves 46 formed within the cartridge case 28. In this manner, it is contemplated that through various methods of manufacture, a lesser amount of material may be required to form the cartridge case 28. Moreover, such construction and design will typically result in a lighter weight cartridge case, which may increase the ease with which the system 10 is used. With reference to FIG. 14, some embodiments of the system 10 take this design attribute to a greater level by operatively coupling the first end portion 30 and second end portion 32 of the cartridge case 28 by a plurality of frame members 50 that extend therebetween. In the depicted exemplary embodiment, three frame members are used. However, it is contemplated that a lesser or greater number of frame members may be used to construct the cartridge case 28. Various embodiments of this type may form the cartridge case 28 from a uniform construction or provide the frame members 50 as being removably engageable with the first end portion 30 and/or the second end portion 32. The frame members 50 may be formed from nearly any material desired and may be removably or permanently secured with the first end portion 30 and second end portion 32 through the use of a variety of mechanical fasteners, adhesives and the like. Moreover, the embodiment of the cartridge case 28 depicted in FIG. 14 is provided with a plurality of cavities 34 in the first end portion 30 that have a closed lower end portion while the cavities 36 in the second end portion 32 penetrate completely through the second end portion 32. It is contemplated that the cavities 34 and cavities 36 may be provided to have solid or open end portions and may be provided to the cartridge case 28 in various or alternating design.

Figure 9:
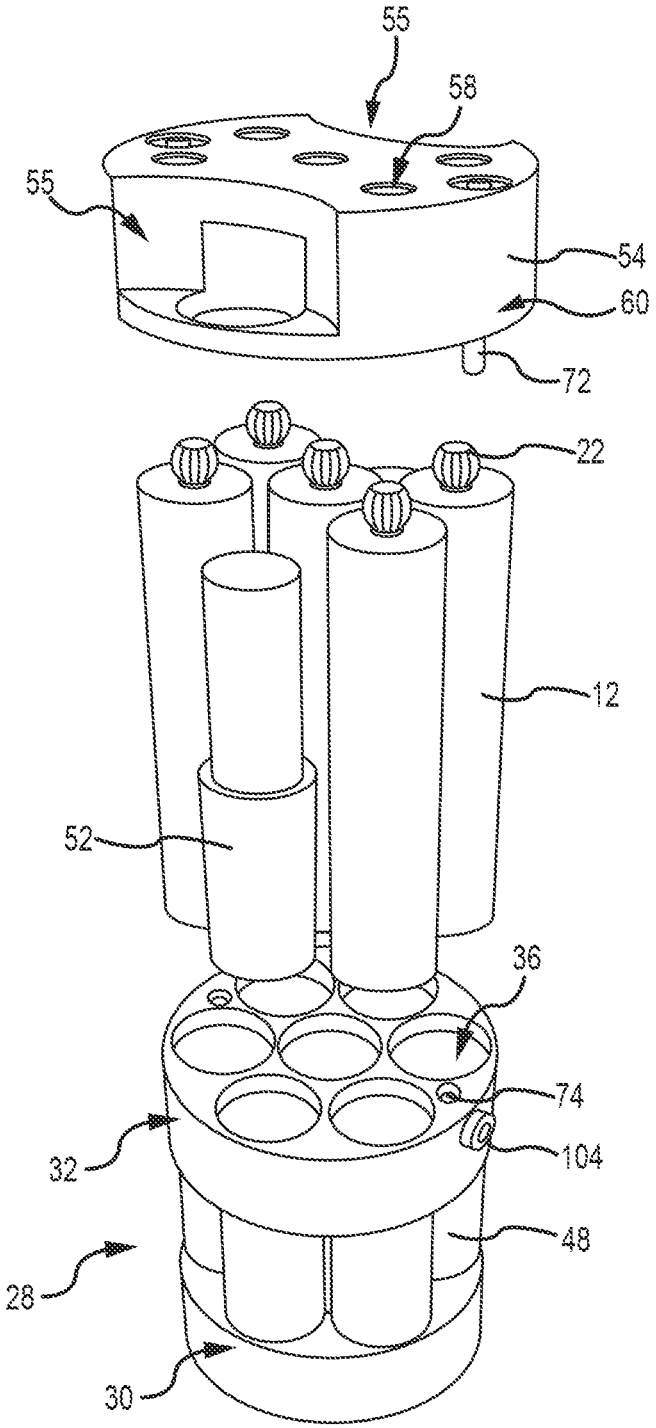
FIG. 9 depicts an isometric, partially exploded view of another embodiment of the system for providing custom colored sealing materials.
Figure 10:
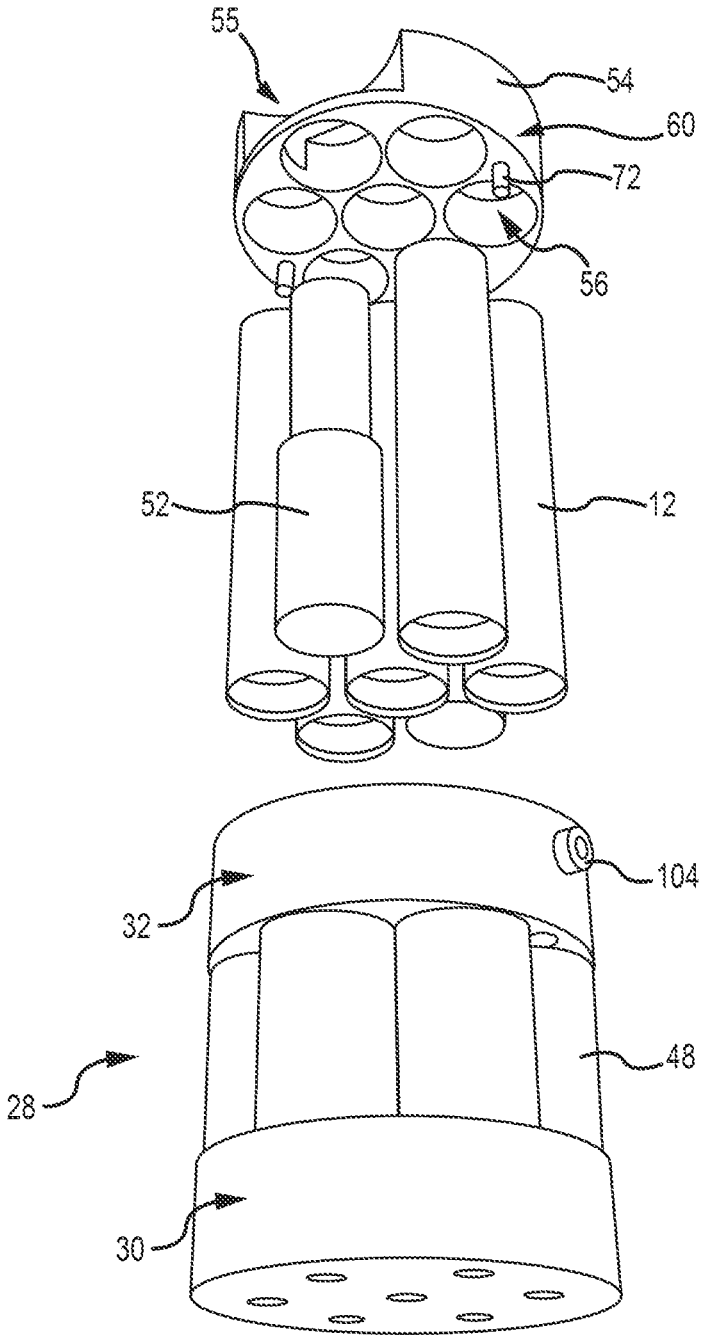
FIG. 10 depicts another isometric, partially exploded view of the system for providing custom colored sealing materials depicted in FIG. 9.
Figure 11:
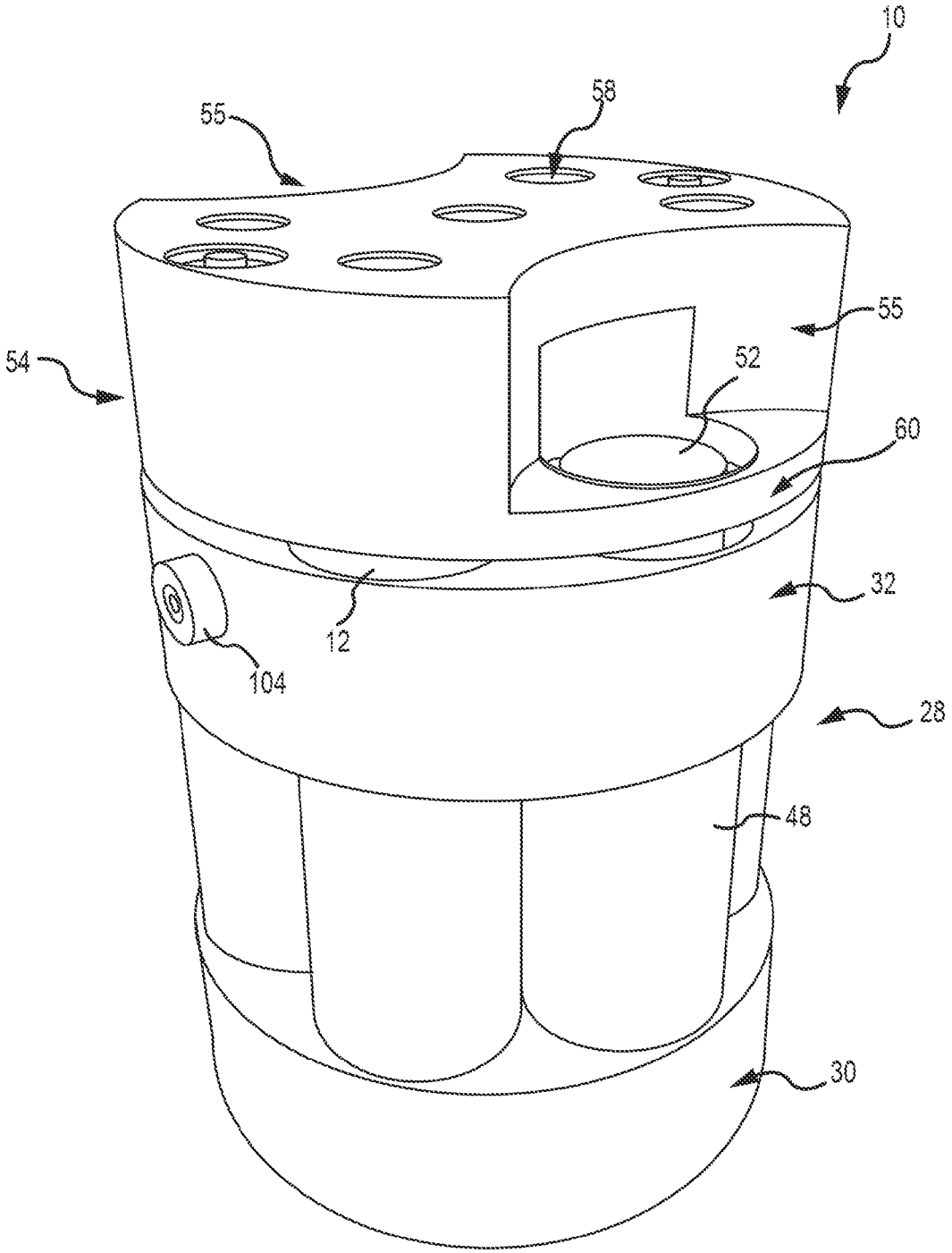
FIG. 11 depicts one assembled embodiment of the system for providing custom colored sealing materials depicted in FIGS. 9 and 10.

With reference to FIGS. 9-11, it is contemplated that certain uses of the system 10 will provide a greater number of cartridge receptacles 40 within the cartridge case 28 than the total number of dispensing cartridges 12 to be used. In such situations, it may be desirable to include one or more weights 52 that are shaped at least similarly to the dispensing cartridges 12 being used. Moreover, the weights 52 may be provided to have a weight and weight dispersion along the weights structure that is at least similar to the weight and weight dispersion of a dispensing cartridge 12 being used. In this manner, the mass supported within the cartridge case 28 may be evenly distributed to provide a balanced load during agitation or other maneuvering of the cartridge case 28 when it is loaded into a mechanical mixing machine.

With reference to FIGS. 9-11, the system 10, in various embodiments, will be provided with an end cap 54 that may be selectively secured with the first end portion 30 of the cartridge case 28 in a manner that retains the one or more dispensing cartridges 12 within the cartridge receptacles 40 when the dispensing cartridges 12 are in the mixing position. In various embodiments of the end cap 54, a lower surface of the end cap 54 may be provided with a plurality of cavities 56 that align with the cartridge receptacles 40 when the end cap 54 is aligned with the cartridge case 28 in a mixing position. The cavities 56 will be sized and shaped similarly to the cavities 36 formed in the second end portion 32 of the cartridge case 28. In this manner, the cavities 56 may securely receive the first end portions 14 of the dispensing cartridges 12. In some embodiments, openings 58 pass from the ends of the cavities 56 through the top end portion or surface of the end cap 54. In some embodiments, the openings 58 are provided with a diameter sufficient that the caps 22, positioned on the threaded nubs 20 of the dispensing cartridges 12, are accessible to be removed from or inserted onto the threaded nub 20. However, in many embodiments, the top portions of the caps 22 will either be flush with or just below the top surface of the end cap 54. In some embodiments, the end cap 54 will be shaped to rest on the first end portions 14 of the dispensing cartridges 12, leaving a lower edge portion 60 of the end cap 54 in a spaced-apart relationship with the second end portion 32 of the cartridge case 28. In at least some embodiments, the length of the cartridge case 28, irrespective of whether or not an end cap 54 is used, will not exceed a total length of approximately 9.25 inches, coinciding with a standard length of a one gallon paint can, thus providing adequate clearance within paint mixing machines while in operation.

Figure 12:
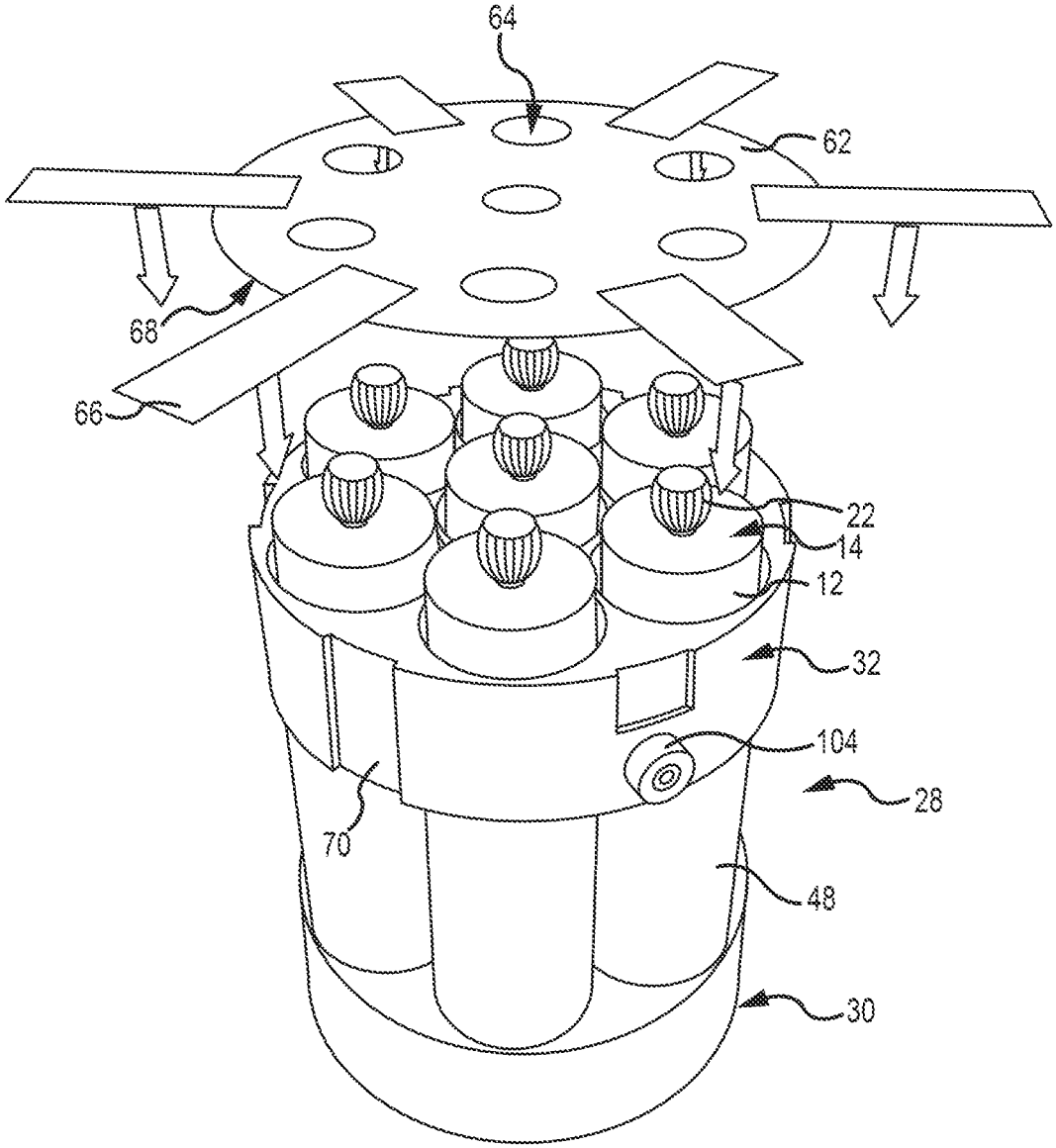
FIG. 12 depicts an isometric, partially exploded view of still another embodiment of the system for providing custom colored sealing materials.
Figure 13:
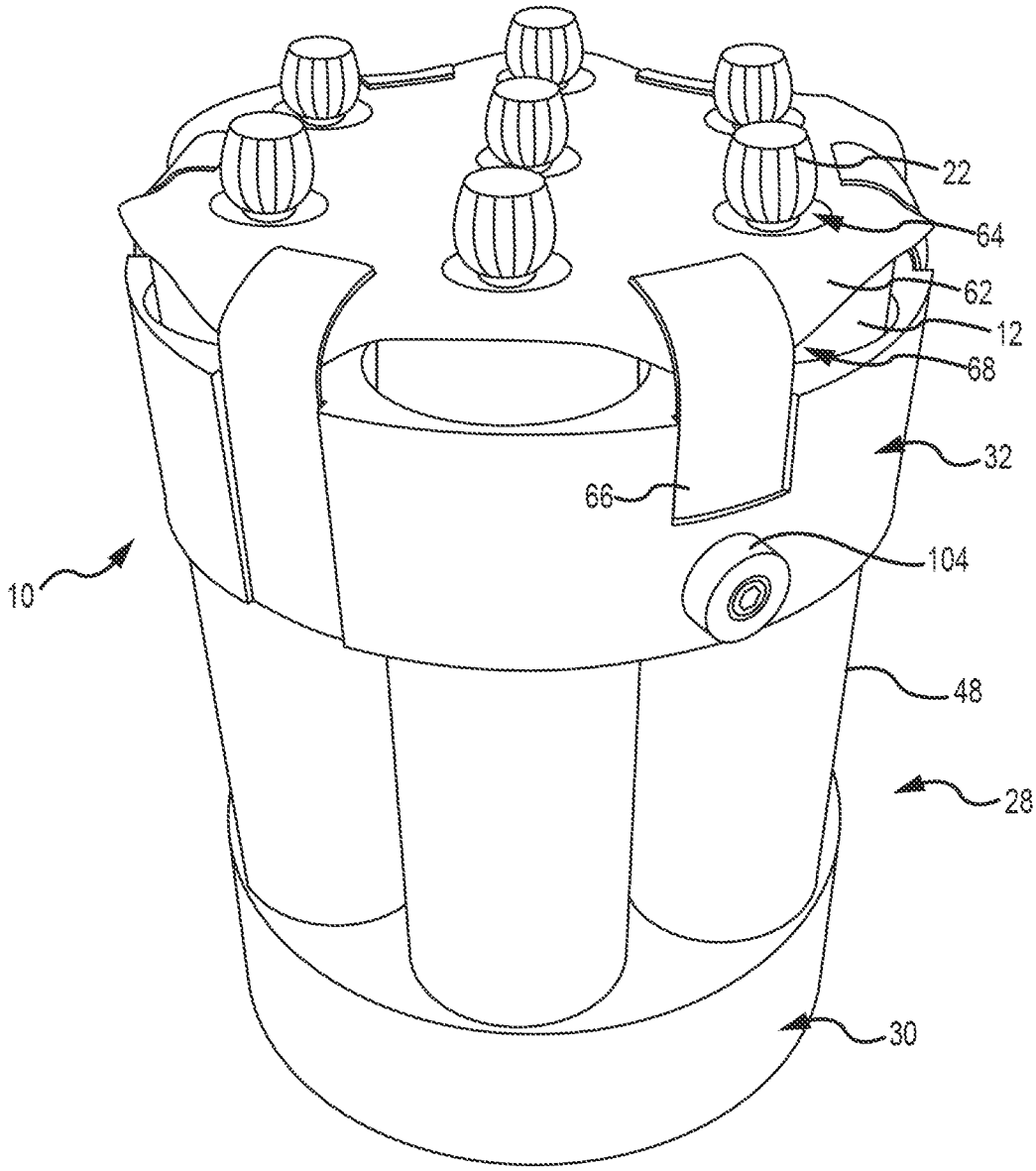
FIG. 13 depicts an isometric view of the system for providing custom colored sealing materials of FIG. 12 in an assembled, or mixing, orientation.
Figure 14:
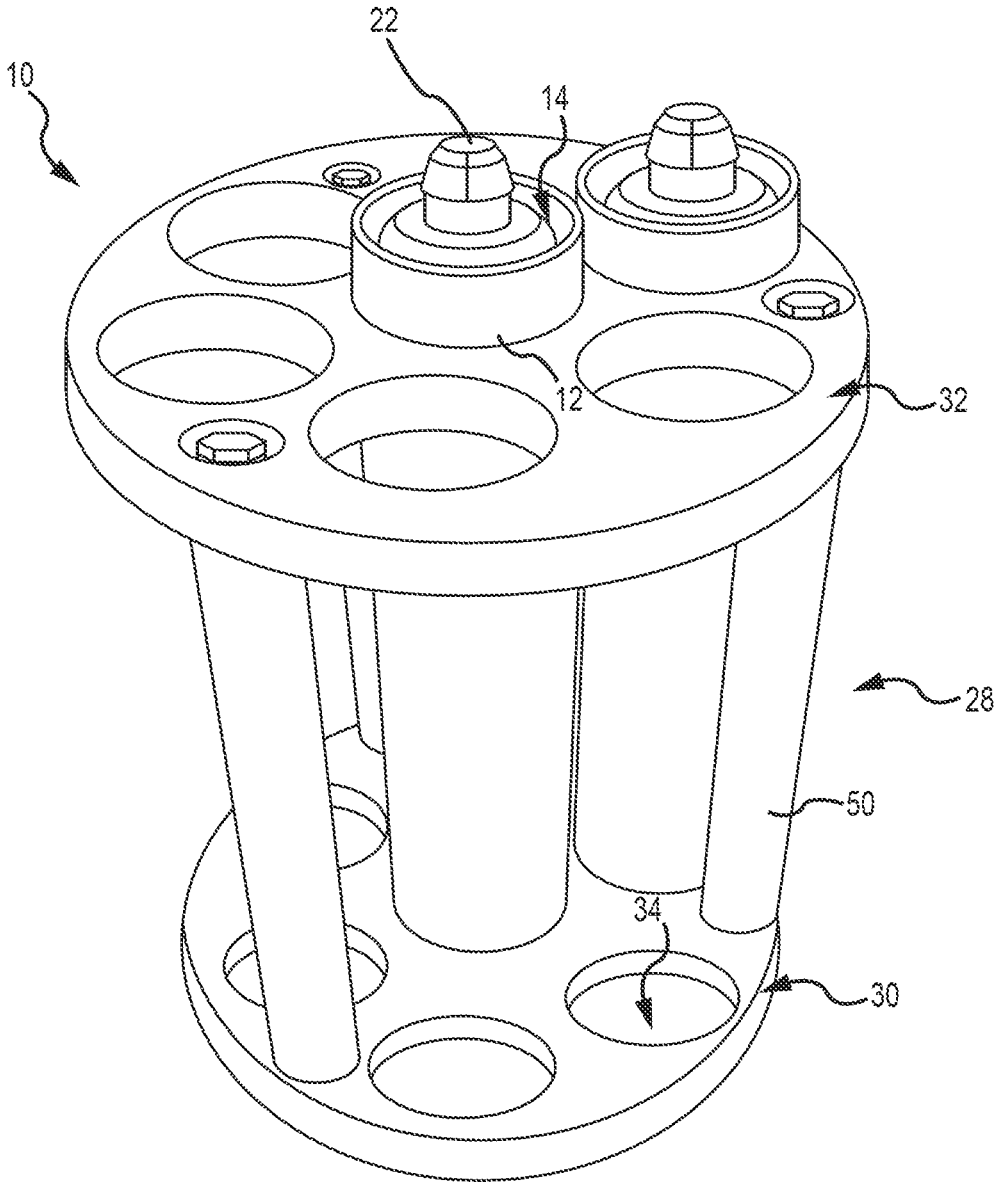
FIG. 14 depicts an isometric view of yet another embodiment of a cartridge case that may be used with the system for providing custom colored sealing materials.
Figure 15:
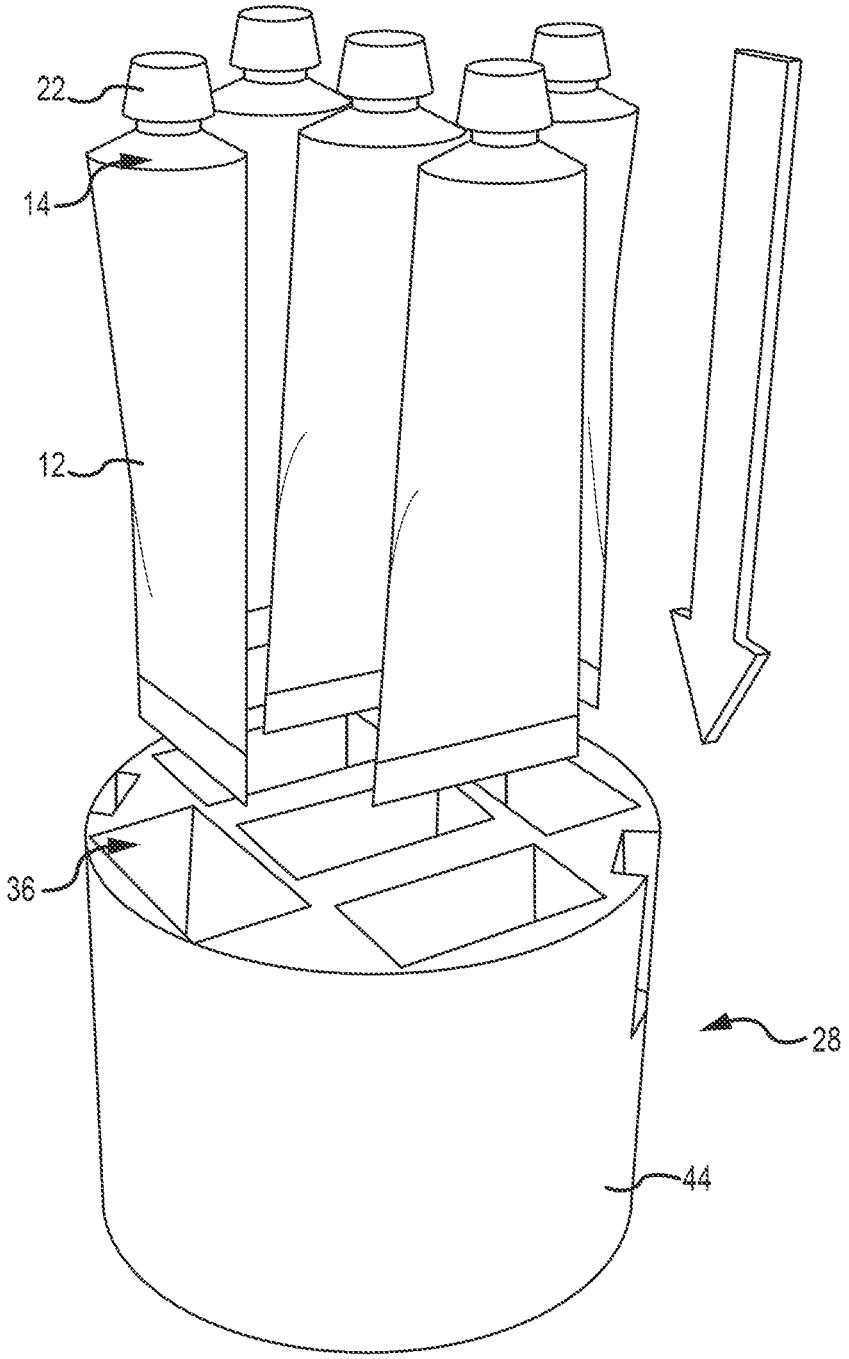
FIG. 15 depicts another embodiment of a cartridge case that may be used with the system for providing custom colored sealing materials as the same may be used to receive squeeze tube dispensing cartridges.
Figure 16:
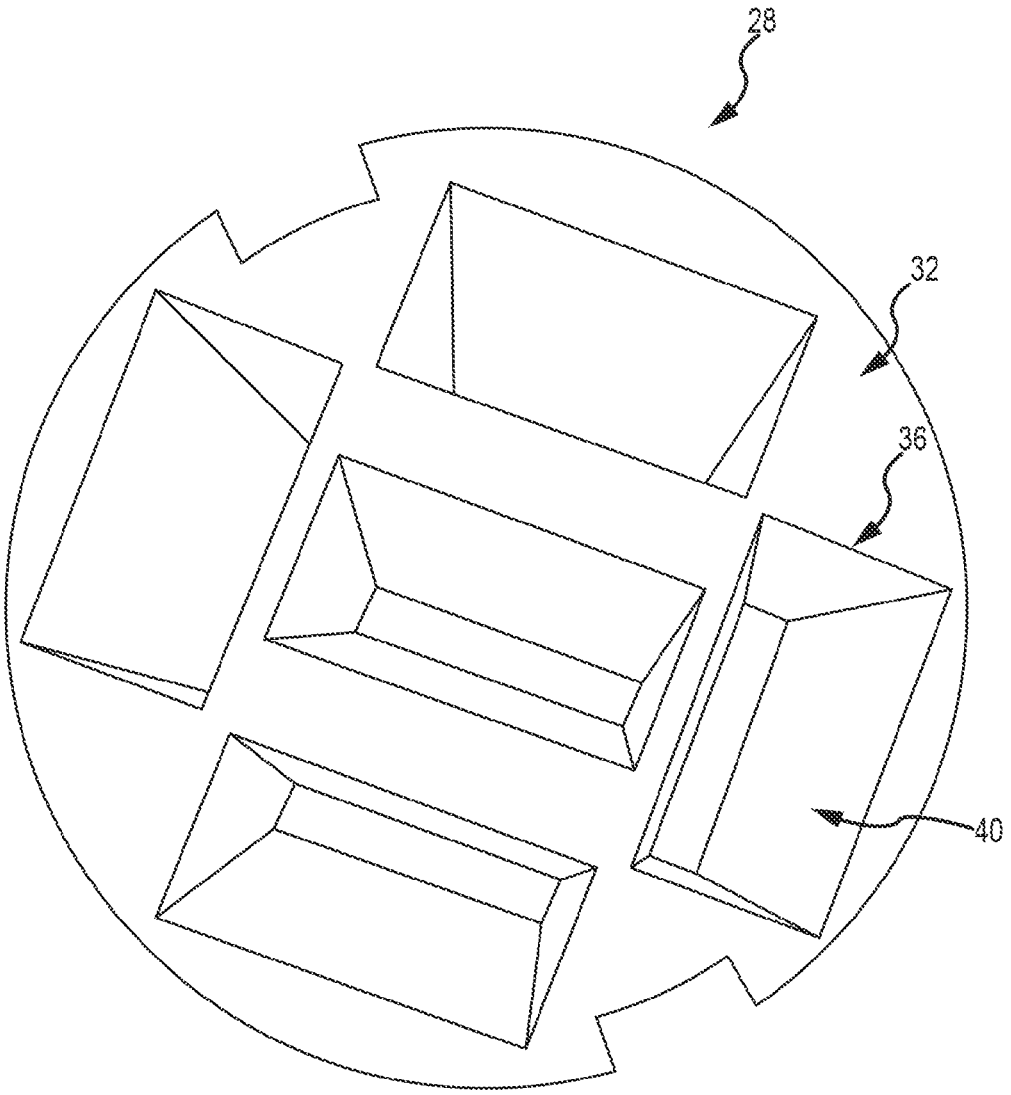
FIG. 16 depicts a top, plan view of the cartridge case depicted in FIG. 15.

With reference to FIGS. 12 and 13, some embodiments may employ a flexible end cap 62, formed from one or more of a variety of flexible materials, such as various plastics, natural and synthetic rubbers, and the like. In many embodiments, the flexible end cap 62 will be provided with a plurality of cap openings 64 that are shaped to permit the caps 22 of the dispensing cartridges 12 to pass therethrough. In this manner, the flexible end cap 62 may rest against the first end portions 14 of the dispensing cartridges 12. It is contemplated that various types of mechanical fasteners may be used to secure the flexible end cap 62 with the first end portion 30 of the cartridge case 28, such that the flexible end cap 62 is positioned in a spaced-apart relationship with the second end portion 32 of the cartridge case 28. Such mechanical fasteners may include one or more of various bolts, screws, and the like. However, in at least one embodiment, a plurality of straps 66 extend from a peripheral edge portion 68 of the flexible end cap 62. While the strap 66 may be provided in the form of rigid members, various embodiments will use flexible straps to accommodate for variations in fit and orientation of the flexible end cap 62 with the cartridge case 28. Hook and loop material 70 or other types of mechanical fasteners may be used to secure the straps 66 with the second end portion 32 of the cartridge case 28. Where a rigid end cap 54 is used with the system 10, one or more locking pins 72 may be provided to extend from the end cap 54 in positions to be received by one or more sockets 74 that extend into the second end portion 32 of the cartridge case 28. The one or more locking pins 72 and sockets 74 will be shaped to releasably engage one another in a friction fit-type orientation, whereby unintentional removal of the end cap 54 is substantially prevented.

While it is contemplated that several embodiments of the system 10 will be provided with a cartridge case 28 having one or more cartridge receptacles 40, having a circular cross-section, other shapes are contemplated. For example, with reference to FIGS. 15, 16, 30 and 31, some embodiments of the system 10 may be provided with cartridge receptacles 40 formed, at least in part, with a generally rectangular cross-section, and a tapered volume over a length of the cartridge receptacles 40, whereby generally tapered, sealant squeeze tubes may fit within the cartridge receptacles 40. Other cross-sectional shapes and volumes are contemplated to receive various types of dispensing cartridges 12, whether they are sealant squeeze tubes, cylindrical sealant cartridges, or variations thereof.

Figure 18:
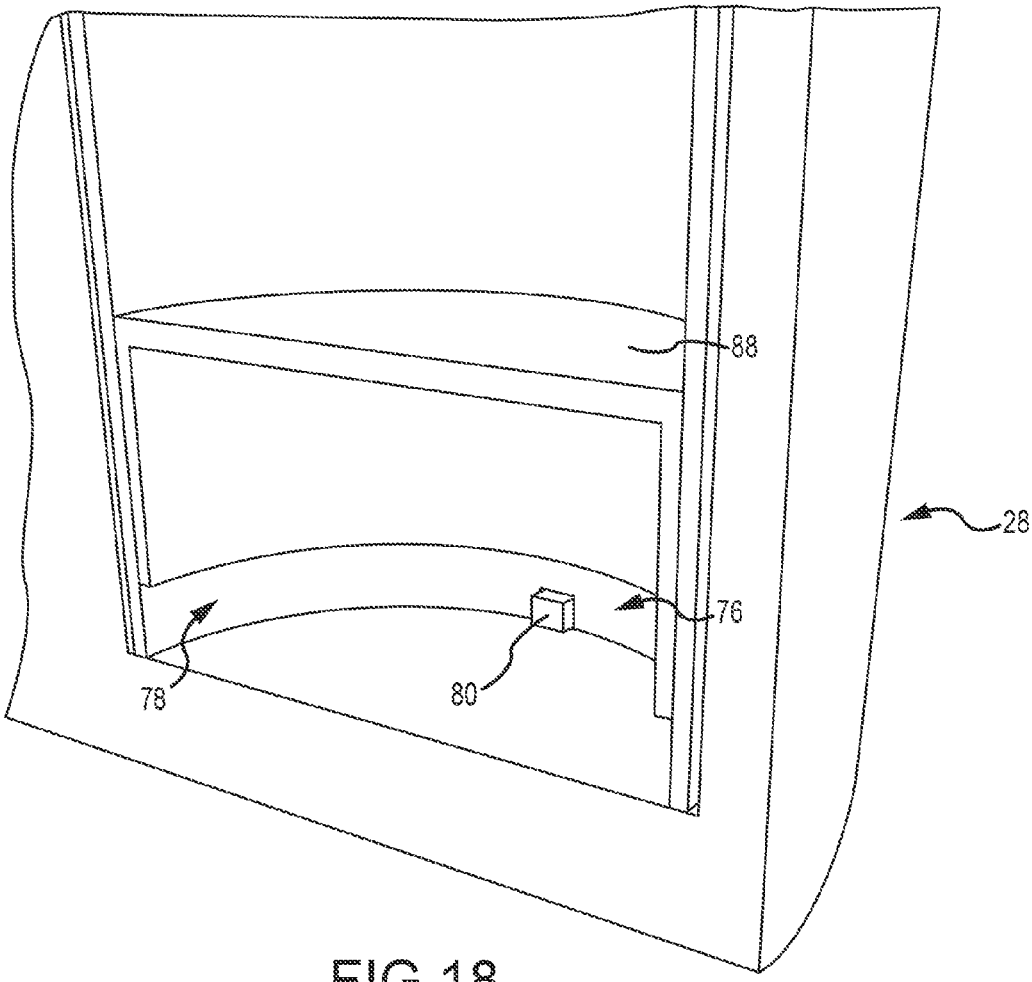
FIG. 18 depicts a partial, isometric view of the cartridge case and dispensing cartridge of FIG. 17 in a mixing orientation.
Figure 19:
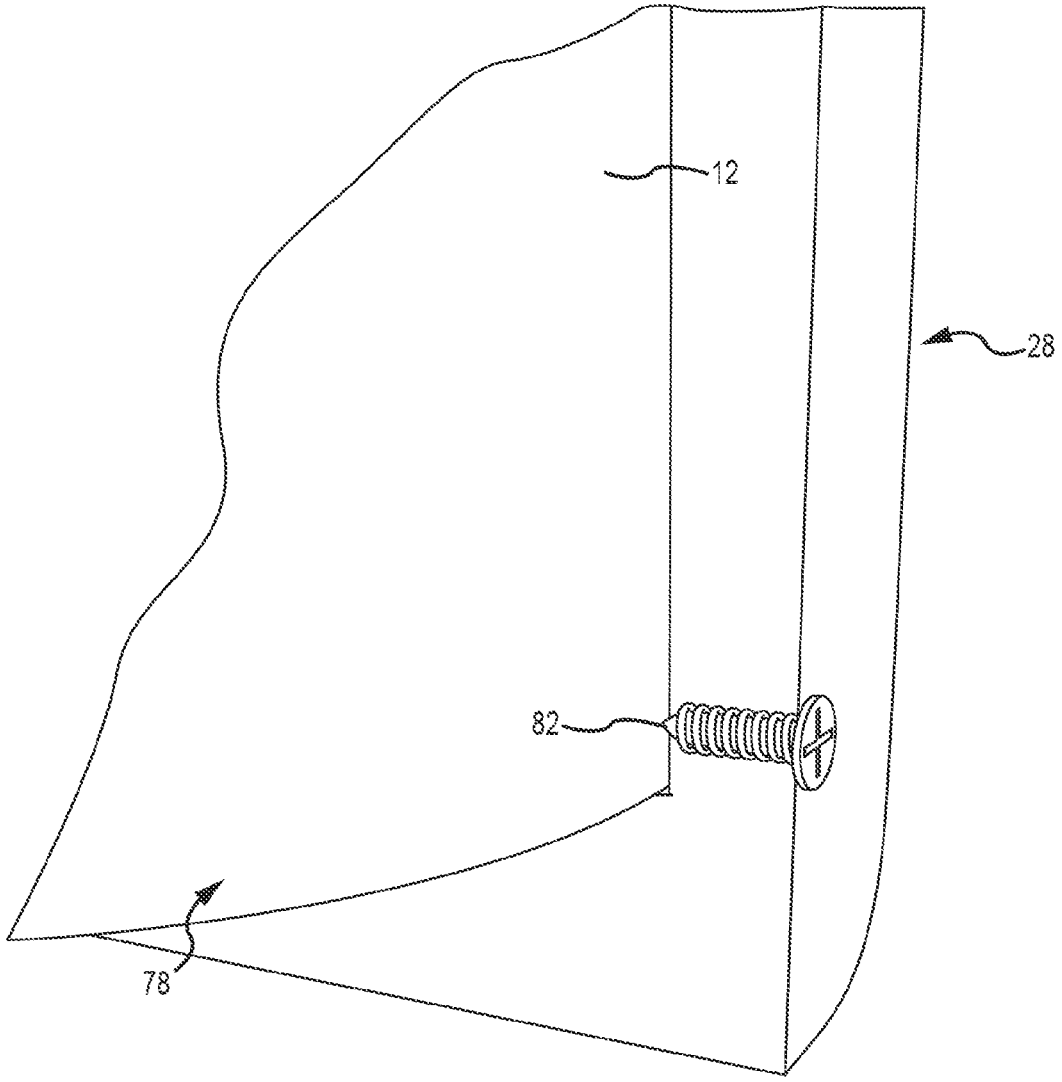
FIG. 19 depicts a partial, isometric view of another embodiment of a cartridge case and dispensing cartridge that are provided in a manner that resists rotation of the dispensing cartridge within the cartridge case.
Figure 20:
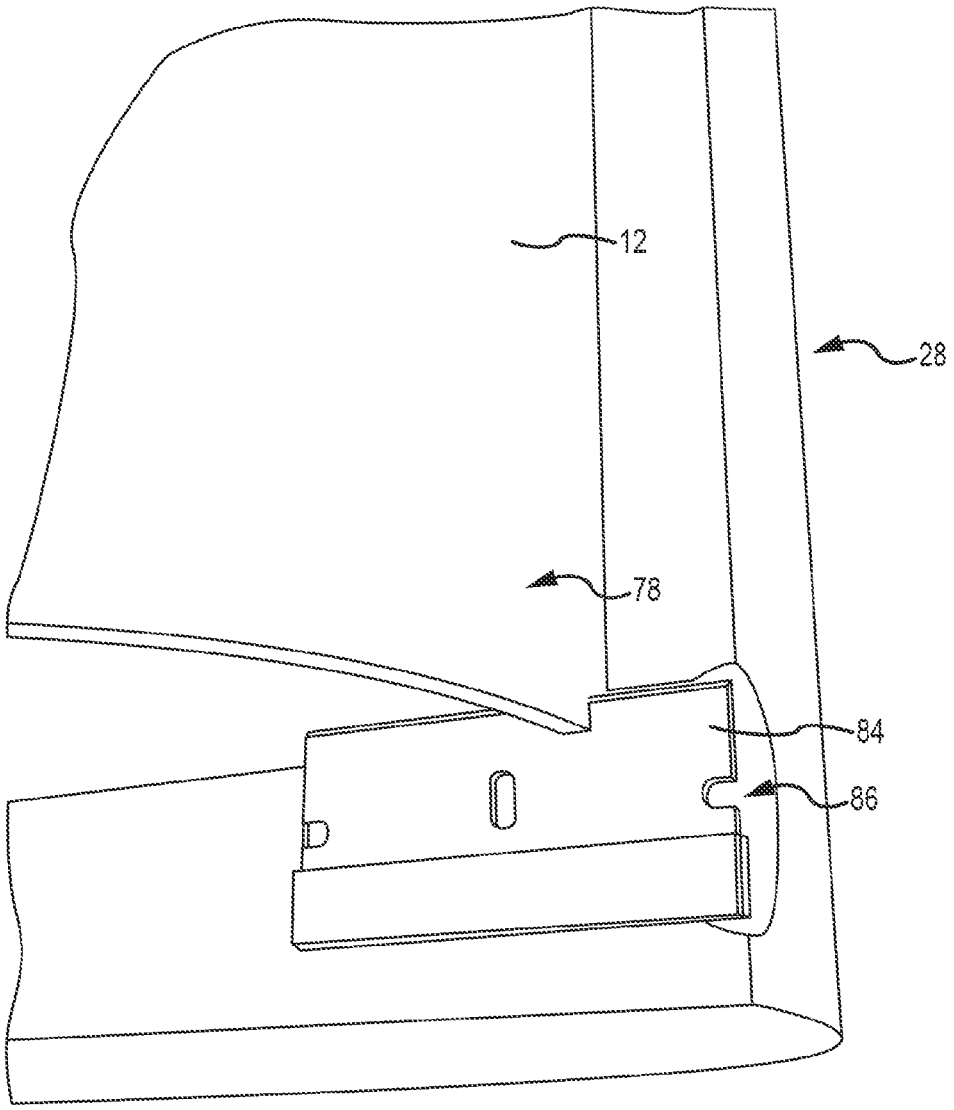
FIG. 20 depicts a partial, isometric view of still another embodiment of a cartridge case and dispensing cartridge that are provided in a manner that resists rotation of the dispensing cartridge within the cartridge case.

It is contemplated that various mixing and agitating movements of the cartridge case 28 will cause the dispensing cartridges 12 to rotate within the cartridge receptacles 40. Such rotational movement will tend to be counterproductive to a mixing or agitating movement. Accordingly, various anti-rotation elements may be incorporated into the system 10. With reference to FIGS. 17 and 18, a notch 76 may be formed in the second end portion 78 of the dispensing cartridge 12 and a projection or tooth 80 formed in the cartridge receptacles 40, adjacent the first end portion 30 of the cartridge case 28. In particular, the tooth 80 should be shaped and positioned to be at least partially disposed within the notch 76 when the dispensing cartridge is placed in the mixing position, whereby the dispensing cartridge 12 is prevented from rotating about a long axis with respect to the cartridge case 28. An example of this secured position is depicted in FIG. 18. With reference to FIG. 19, other embodiments may use a projection 82 that extends into the cartridge receptacle 40. The projection 82, such as a screw, tack, or the like, will be shaped and positioned to frictionally engage the dispensing cartridge 12 when the dispensing cartridge 12 is placed in the mixing position. With reference to FIG. 20, still other embodiments may employ a blade 84 that is positioned to extend into the cartridge receptacle 40 so that a cutting edge of the blade 84 engages a portion of the dispensing cartridge 12 when the dispensing cartridge 12 is placed in the mixing position, whereby the dispensing cartridge 12 is prevented from rotating with respect to the cartridge case 28. In various embodiments, the blade 84 may be provided in the form of a razor blade that is removably disposed in the cartridge case 28 through a slot 86, formed radially into a side portion of the cartridge case 28.

Figure 21:
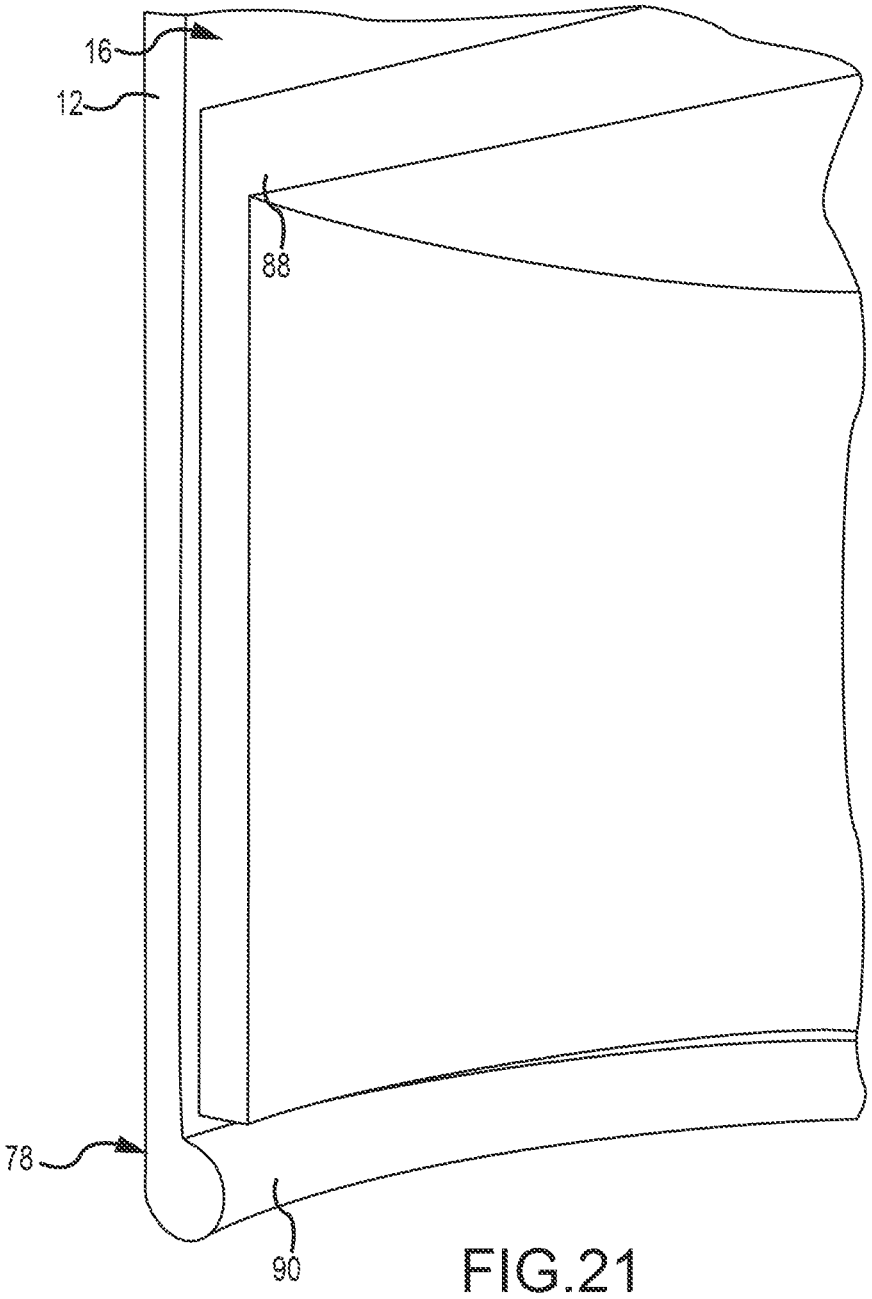
FIG. 21 depicts a partial, isometric view of a dispensing cartridge that may be used with the system for providing custom colored sealing materials and resists the unintentional withdrawal of the plunger from the dispensing cartridge.
Figure 22:
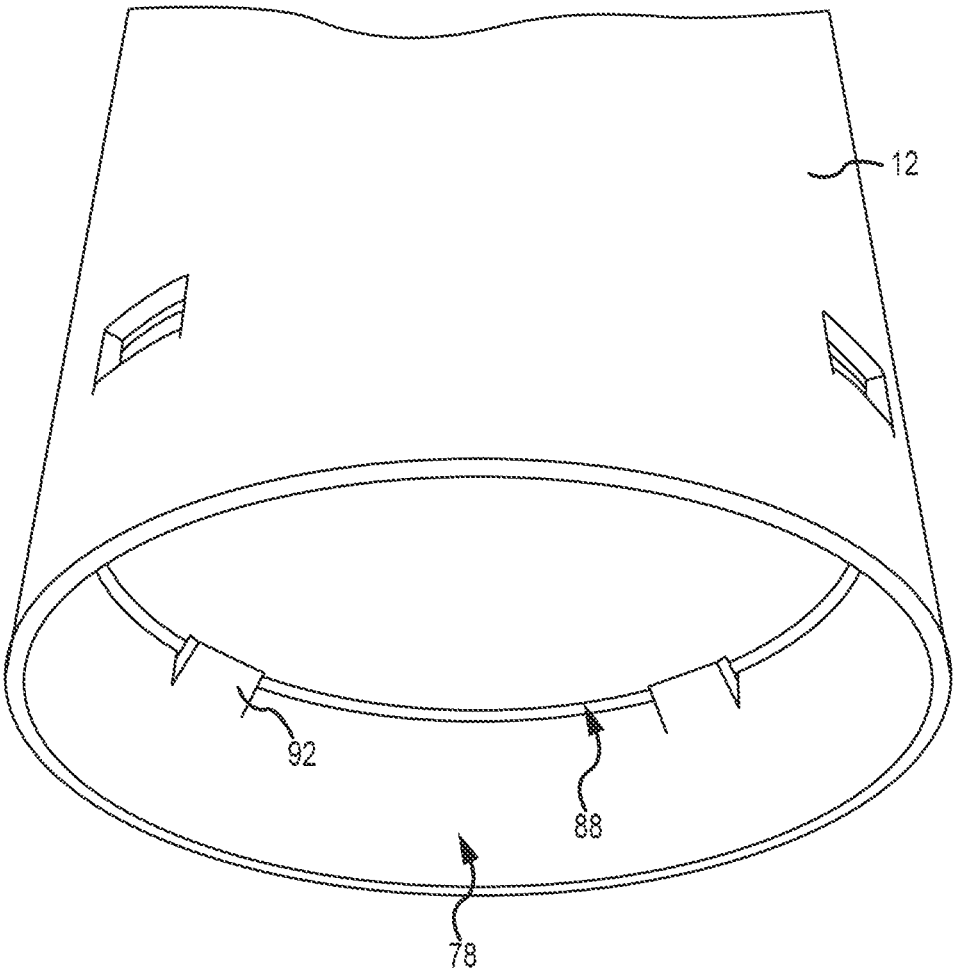
FIG. 22 depicts a partial, isometric view of still another embodiment of a dispensing cartridge that may be used with the system for providing custom colored sealing materials, including another manner in which the unintentional withdrawal of the plunger from the dispensing cartridge may be prevented.
Figure 23:
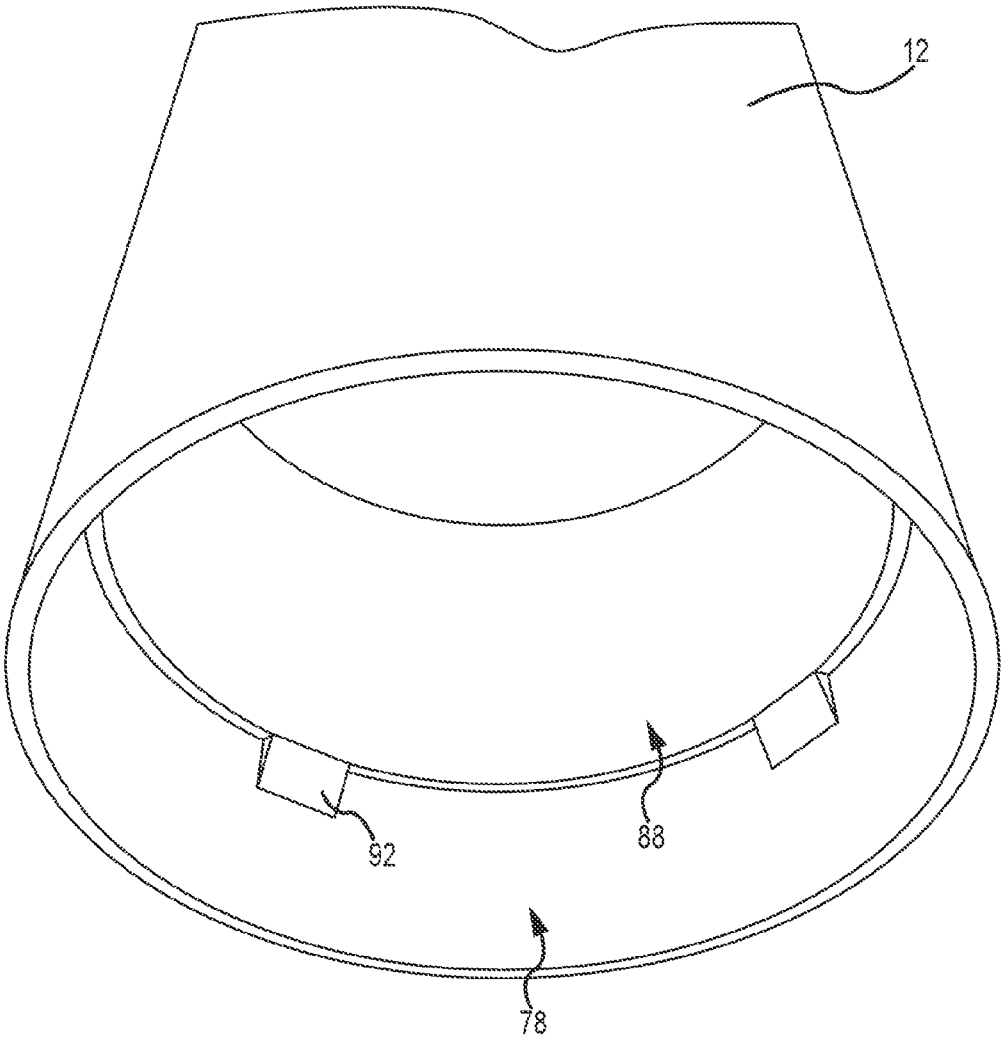
FIG. 23 depicts a partial, isometric view of still another embodiment of a dispensing cartridge that may be used with the system for providing custom colored sealing materials, including another manner in which the unintentional withdrawal of the plunger from the dispensing cartridge may be prevented.
Figure 24:
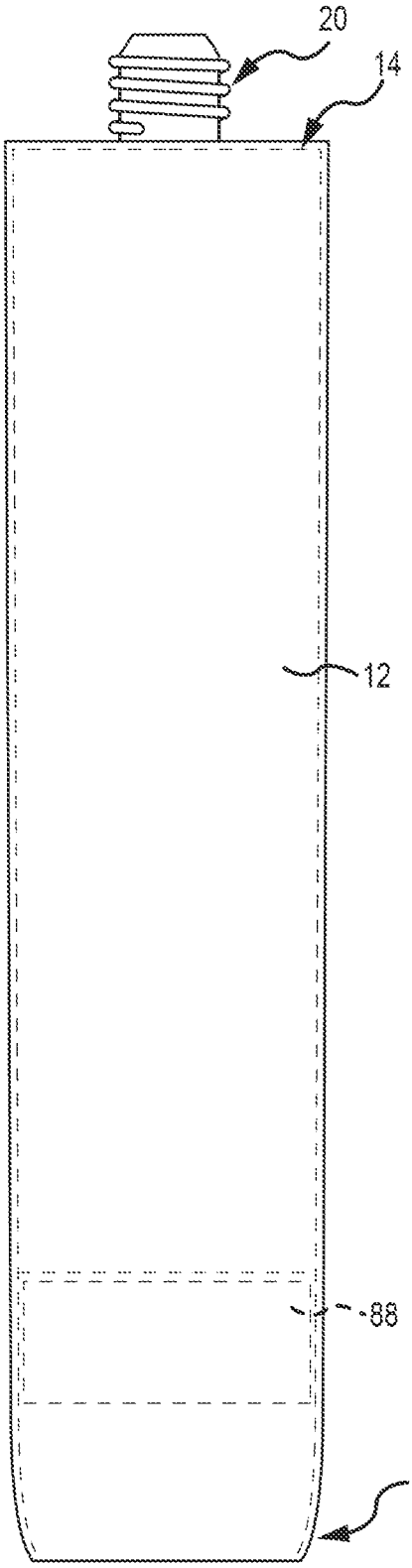
FIG. 24 depicts a side elevation view of another embodiment of a dispensing cartridge that may be used with the system for providing custom colored sealing materials that further prevents the unintentional withdrawal of the plunger from within the dispensing cartridge.

Various dispensing cartridges 12, such as rigid caulking tubes, will typically use a plunger 88 that is axially, slidably disposed within the dispensing cartridge 12, adjacent the second end portion 78. In some embodiments, a positive stop may be provided to prevent the plunger 88 from unintentionally exiting through the second end portion 78 of the dispensing cartridge 12. Various embodiments may include a lip member 90 that extends radially inwardly from the second end portion 78 of the dispensing cartridge 12, such as depicted in FIG. 21. With reference to FIG. 22, at least one barb 92 may be provided to extend radially inwardly from the second end portion 78 of the dispensing cartridge 12. Such barbs 92 may simply be formed by pressing a portion of the dispensing cartridge wall inwardly, leaving exposed openings where the barb 92 material used to reside within the wall of the dispensing cartridge 12. With reference to FIG. 23, barbs 92 may simply be formed to the inner wall of the dispensing cartridges 12, where openings through the exterior of the dispensing cartridge 12 are not desired. In still other embodiments, such as depicted in FIG. 24, the second end portion 78 of the dispensing cartridge 12 may be tapered inwardly to a terminal diameter that is less than a diameter of the plunger 88, whereby preventing removal of the plunger 88 from the dispensing cartridge 12. The taper may be formed after the plunger is disposed within the dispensing cartridge 12 during its manufacture. One of various known methods of molding plastic tubing may be employed for tapering the second end portion 78 of the dispensing cartridge 12.

Figure 25:
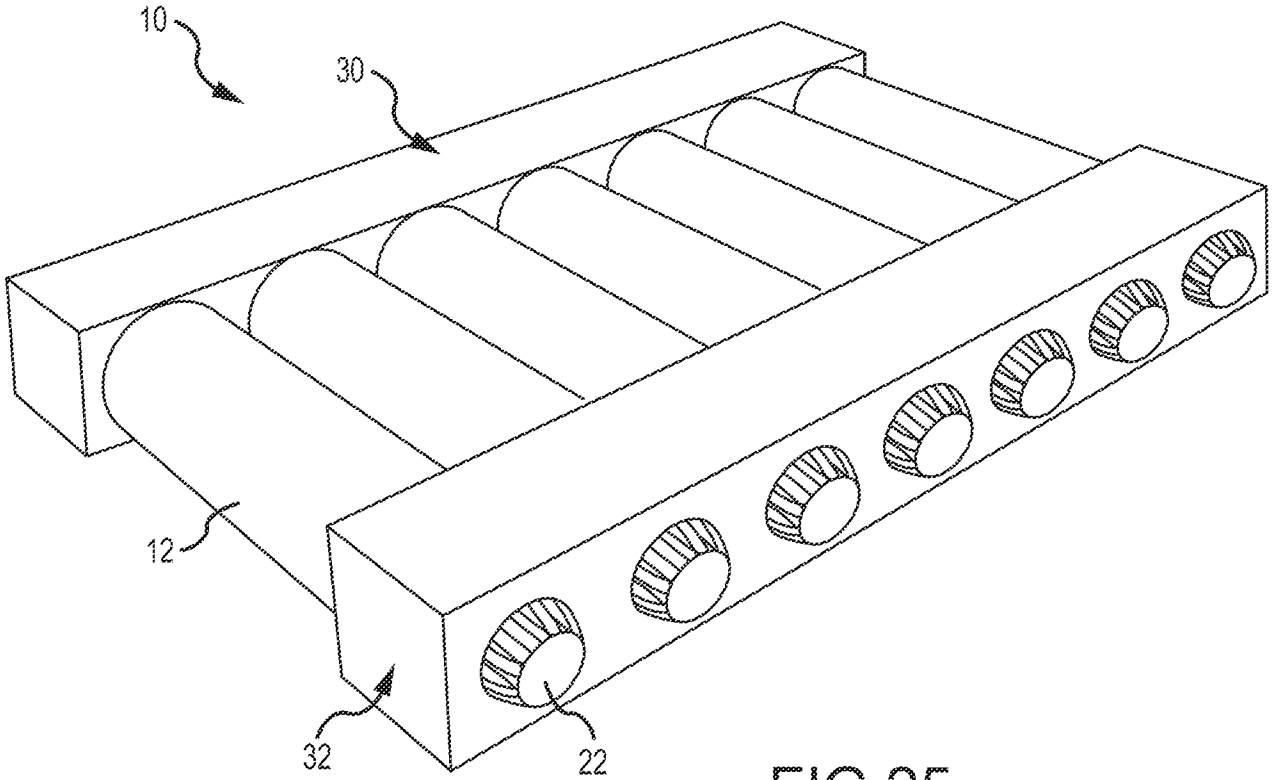
FIG. 25 depicts an isometric view of still another embodiment of the system for providing custom colored sealing materials.
Figure 26:
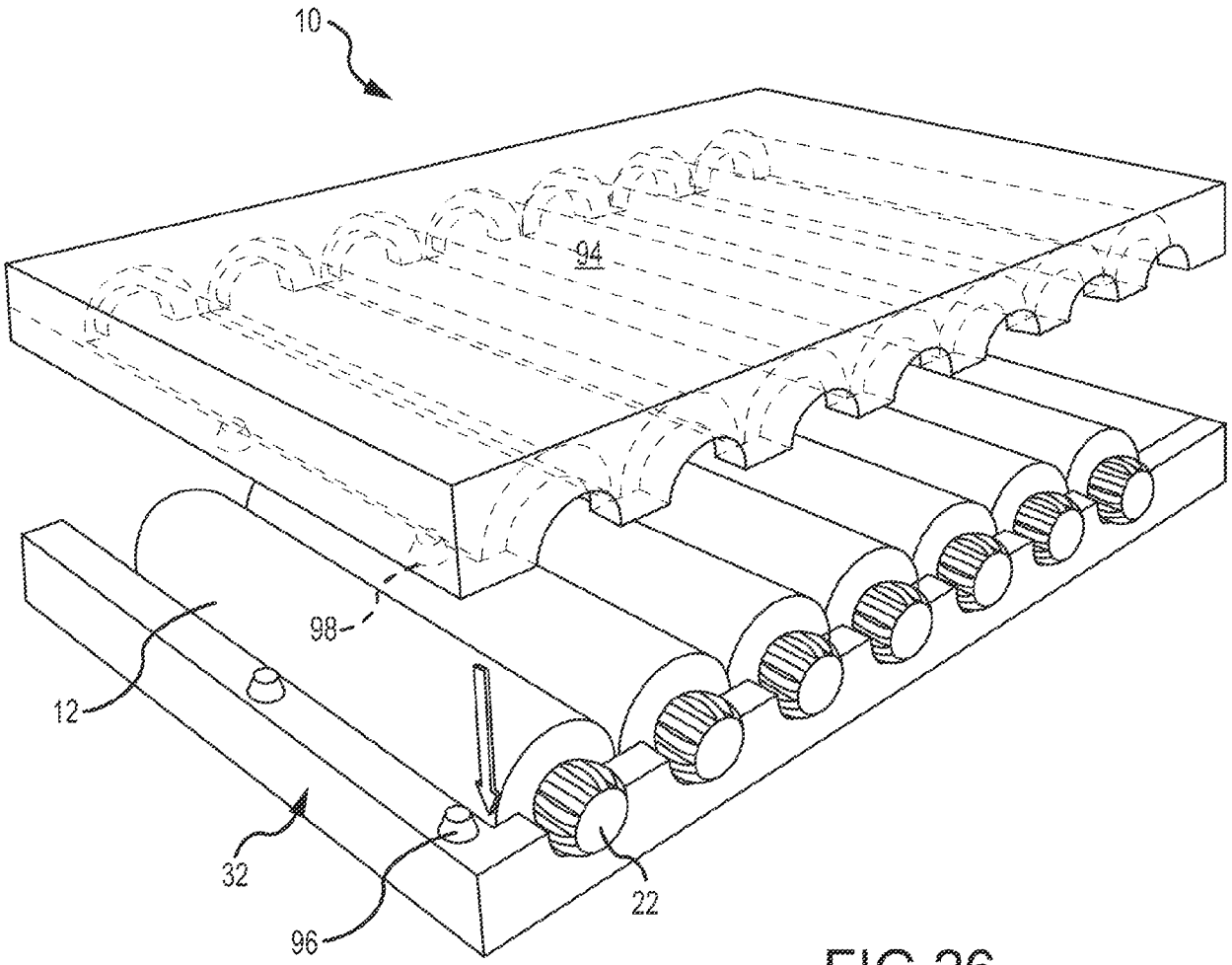
FIG. 26 depicts another embodiment of the system for providing custom colored sealing materials in a partially disassembled orientation.
Figure 27:
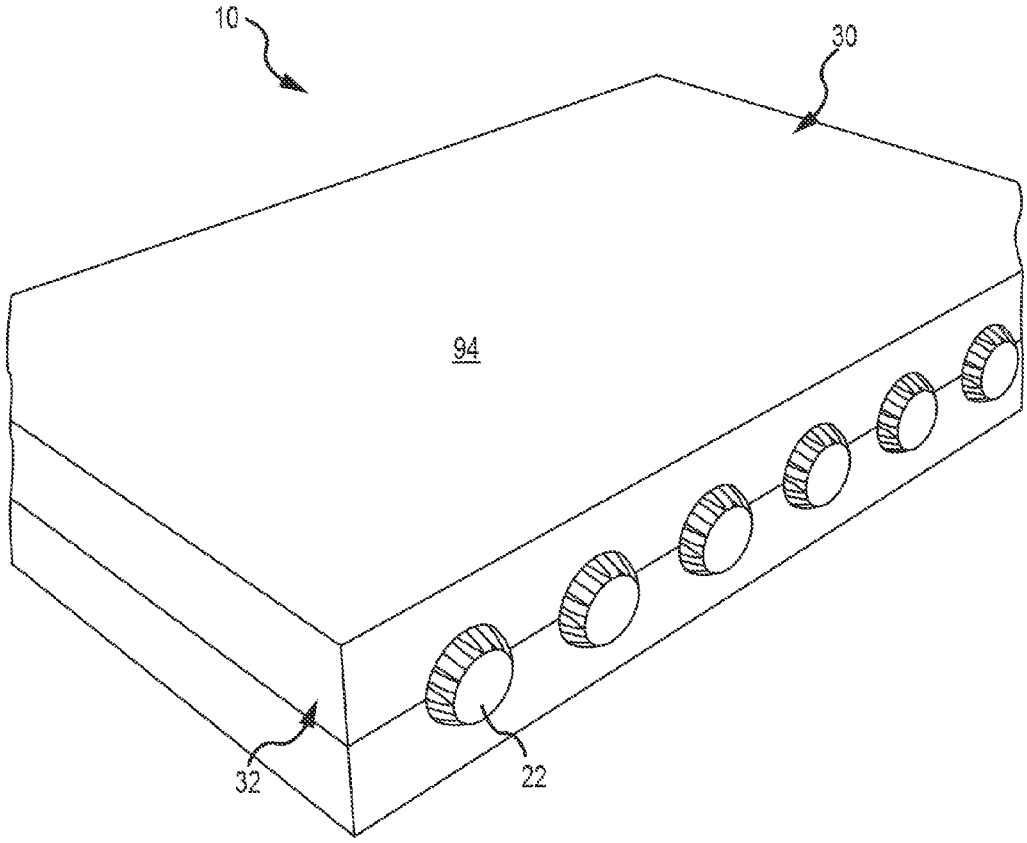
FIG. 27 depicts the system for providing custom colored sealing materials of FIG. 26 in an assembled, or mixing, orientation.
Figure 28:
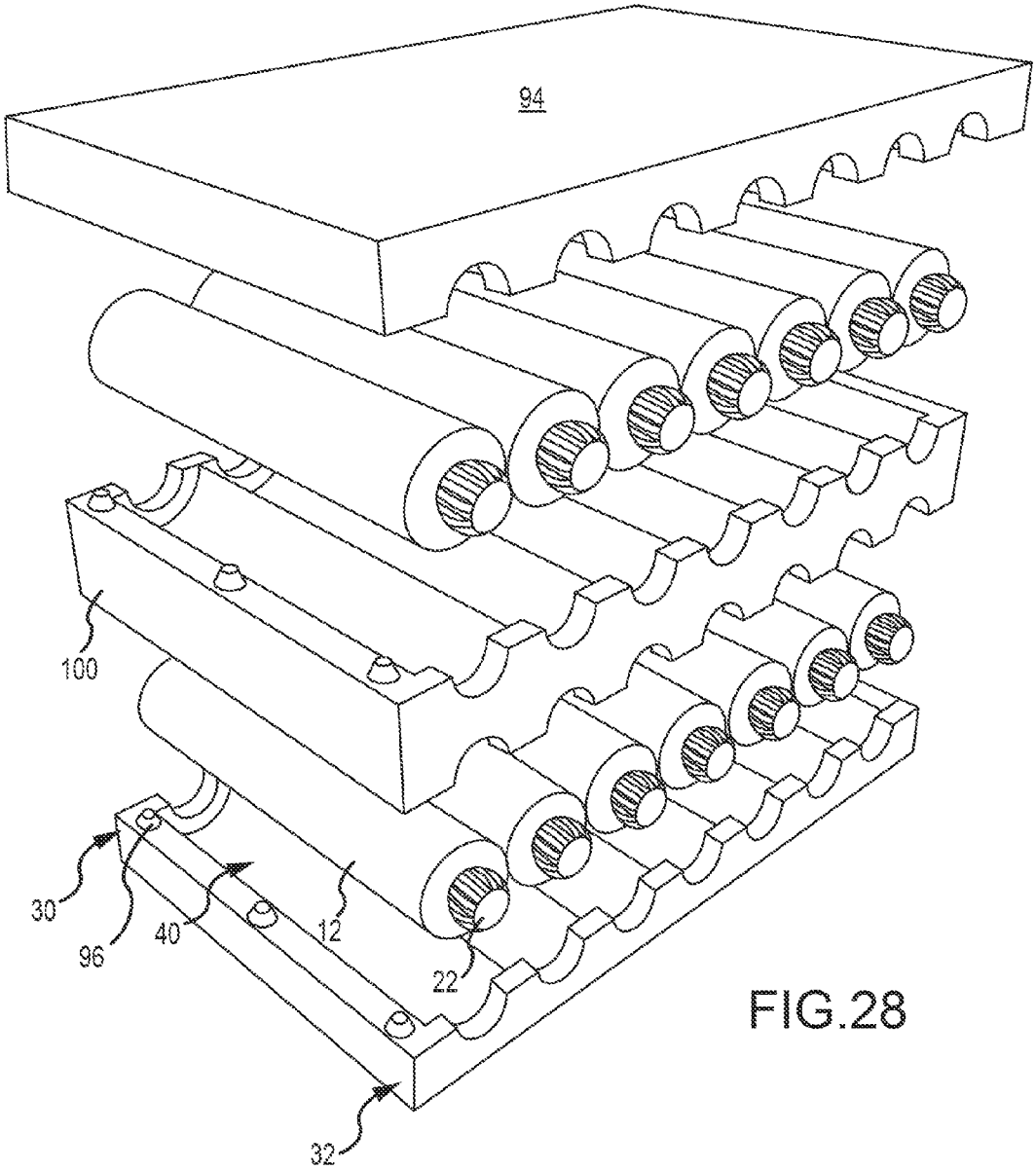
FIG. 28 depicts an isometric, partially exploded view of a further embodiment of the system for providing custom colored sealing materials.
Figure 29:
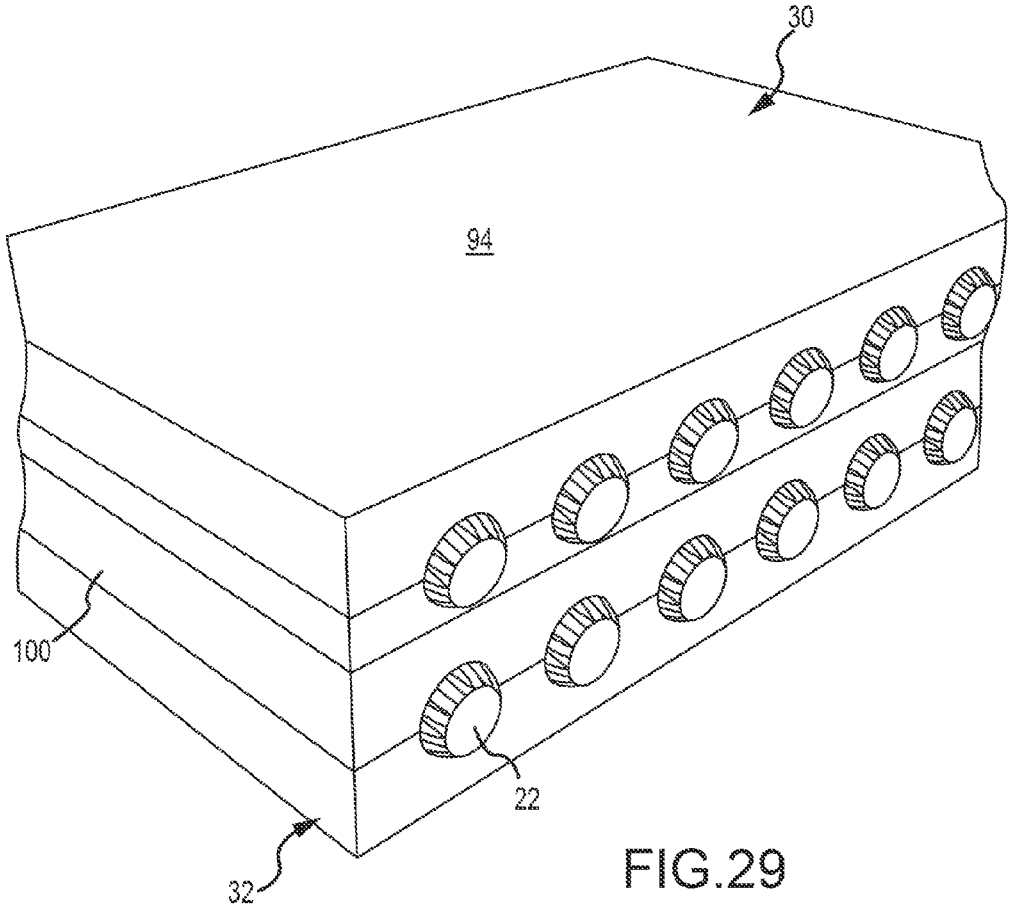
FIG. 29 depicts an isometric view of the system for providing custom colored sealing materials of FIG. 28 in an assembled, or mixing, orientation.
Figure 30:
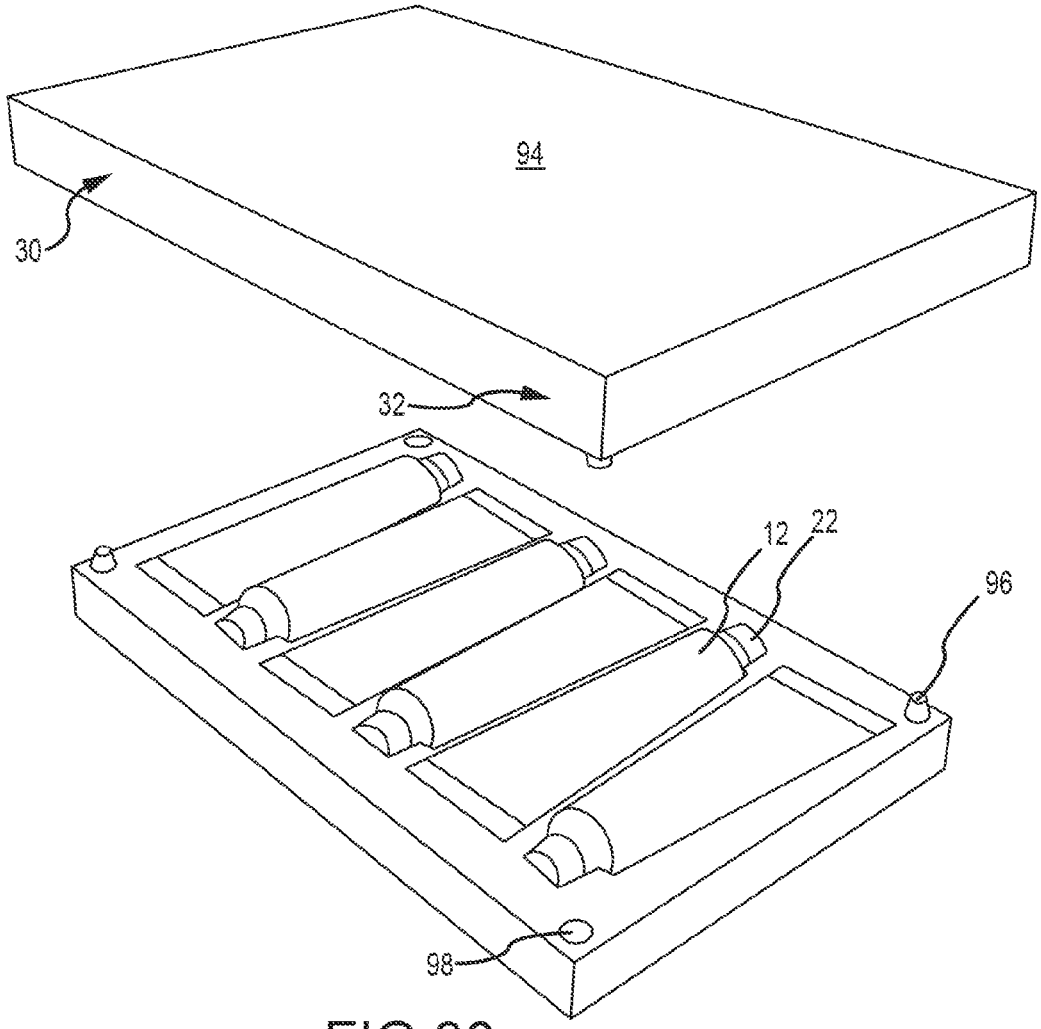
FIG. 30 depicts a partially disassembled, isometric view of another embodiment of the system for providing custom colored sealing materials.
Figure 31:
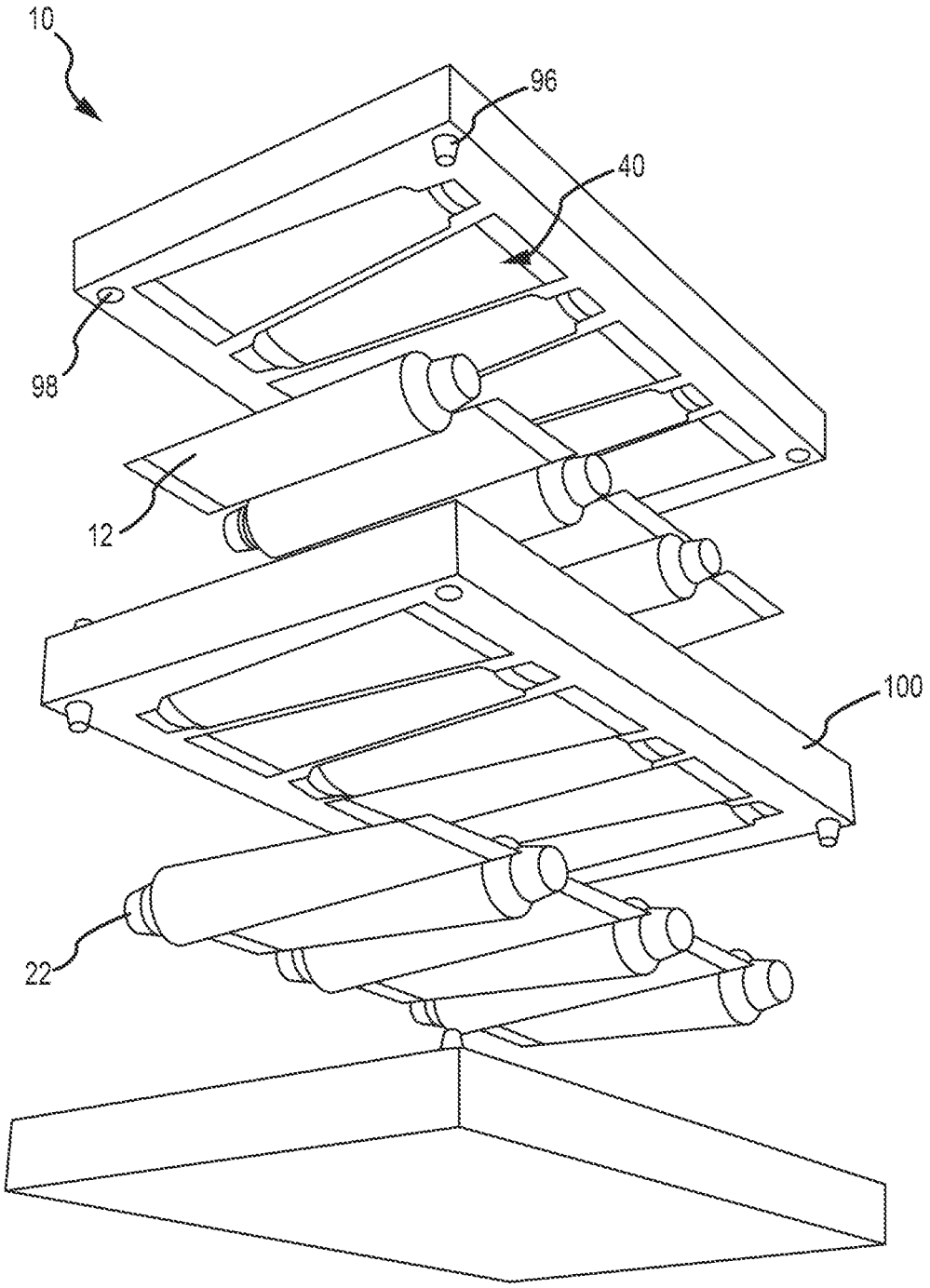
FIG. 31 depicts a partially disassembled, isometric view of yet another embodiment of the system for providing custom colored sealing materials.
Figure 32:
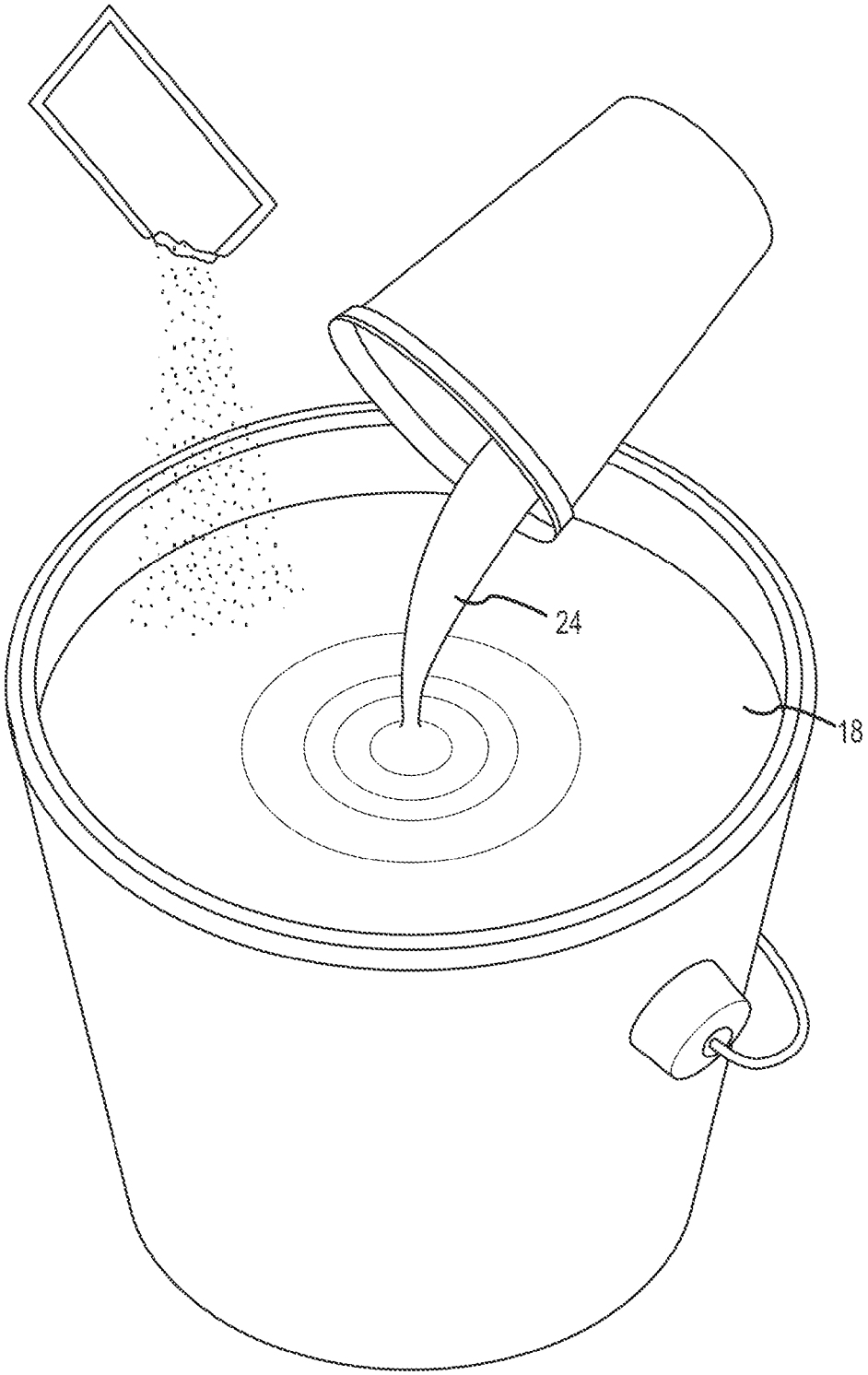
FIG. 32 depicts an isometric view of one embodiment of the system for providing custom colored sealing materials as a quantity of a coloring agent and a quantity of texturizer is added to a quantity of sealant base solution.
Figure 33:
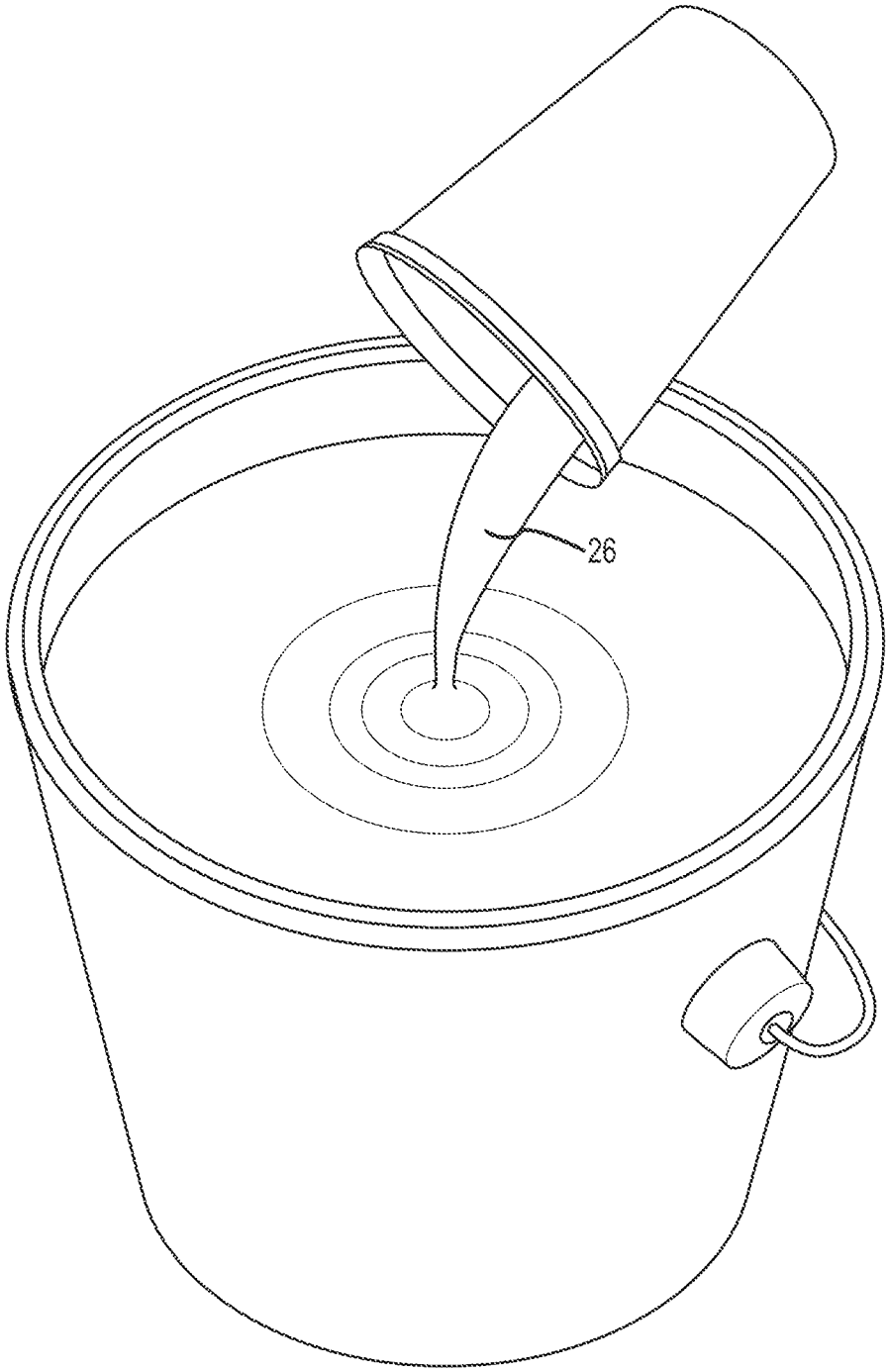
FIG. 33 depicts the system for providing custom colored sealing materials of FIG. 32 and one manner in which a quantity of sealant thickener may be added to the solution within the container.

While various embodiments of the system 10 are provided with a cartridge case 28 having a generally round cross-section, similar to that of a standard paint can, other shapes are contemplated. With reference to FIG. 25, the cartridge case 28 may be formed to have a rectangular cross-section, having a plurality of cartridge receptacles 40 that are placed in a co-planar, linearly spaced-apart orientation with one another. In this manner, a flat, planar array of dispensing cartridges 12 may be provided. While some embodiments may employ separate first end portions 30 and second end portions 32, it is contemplated that other arrangements may be used. In some embodiments, the first end portion 30 and second end portion 32 of the cartridge case 28 are coupled with one another by planar sidewalls 94. The cartridge case 28, in some embodiments, may be divided along a plane that extends along the long axis of the plurality of cartridge receptacles 40, whereby the cartridge case 28 may be divided into two parts to expose lengths of the plurality of cartridge receptacles 40 for loading and unloading dispensing cartridges 12 therefrom. Mounting pins 96 and sockets 98 may be provided between the two halves of the cartridge case 28 to assist in securing their position with respect to one another. In such an embodiment, it is contemplated that the cartridge receptacles 40 may be formed with a generally circular cross-section, whereby generally cyclindrical, rigid sealant tubes may fit within the plurality of cartridge receptacles 40. In other embodiments, the plurality of cartridge receptacles 40 may be formed, at least in part, with a generally rectangular cross-section, and a tapered volume over a length of the cartridge receptacles 40, whereby generally tapered, sealant squeeze tubes may fit within the plurality of cartridge receptacles. An example of such an arrangement is depicted in FIG. 30. With reference to FIGS. 28-31, the planar arrangement of the dispensing cartridges 12 within rectangular or square, planar cartridge cases 28 lends itself to stacking multiple planar rows of dispensing cartridges 12 with respect to one another in a spaced-apart relationship. In such embodiments, spacer walls 100 may be placed between successive rows of dispensing cartridges 12, between the divided halves of the cartridge case 28. Various jobs within the construction arts use sealant materials provided in small-bulk containers, such as one and five gallon buckets. It is contemplated that the present technology may be used in custom coloring such containers of sealant. In such instances, the one or five gallon buckets will become the mixing receptacle, similar to the cartridge case 28.

In use, the system 10 may be employed in a number of various environments. One environment for which this system 10 may be particularly well suited will be a commercial paint store or at a location using one or more various types of mechanical agitators. Various embodiments for the methodology used to custom color sealant, according to the present technology, will not vary greatly, irrespective of the type of dispensing cartridges 12 or cartridge case 28 being used. In particular, a plurality of dispensing cartridges 12 will typically be provided with a quantity of sealant base solution as described hereinabove. The dispensing cartridges will be secured within the cartridge receptacles 40 of the cartridge case 28 being used. With the caps 22 removed from the dispensing cartridges 12, a quantity of one or more coloring agents 24 will be introduced (via a cup, syringe, pipette or other transfer means) to the interior compartment 16 of the dispensing cartridges 12. The caps 22 will then be resecured with the dispensing cartridges 12. The cartridge case 28, once secured in its mixing position, may then be agitated. The agitation step may be performed by hand or with a mechanical agitator. Due to the use of the low viscosity sealant base solution described previously, a complete and uniform mixing of the coloring agent may be attained in approximately 25-60 seconds. Thereafter, a quantity of the sealant thickener 26 may be introduced to the interior compartment of the dispensing cartridges 12. The cartridge case 28 may then be agitated again in a manner similar to that used for incorporating the drying agent 24. It has been found with the aforedescribed materials and embodiments of the system 10 that complete thickening of the sealant base material 18 appears in as few as 45 seconds, either by hand agitiation or by machine, with the resulting product being usable immediately, if desired.

Figure 34:
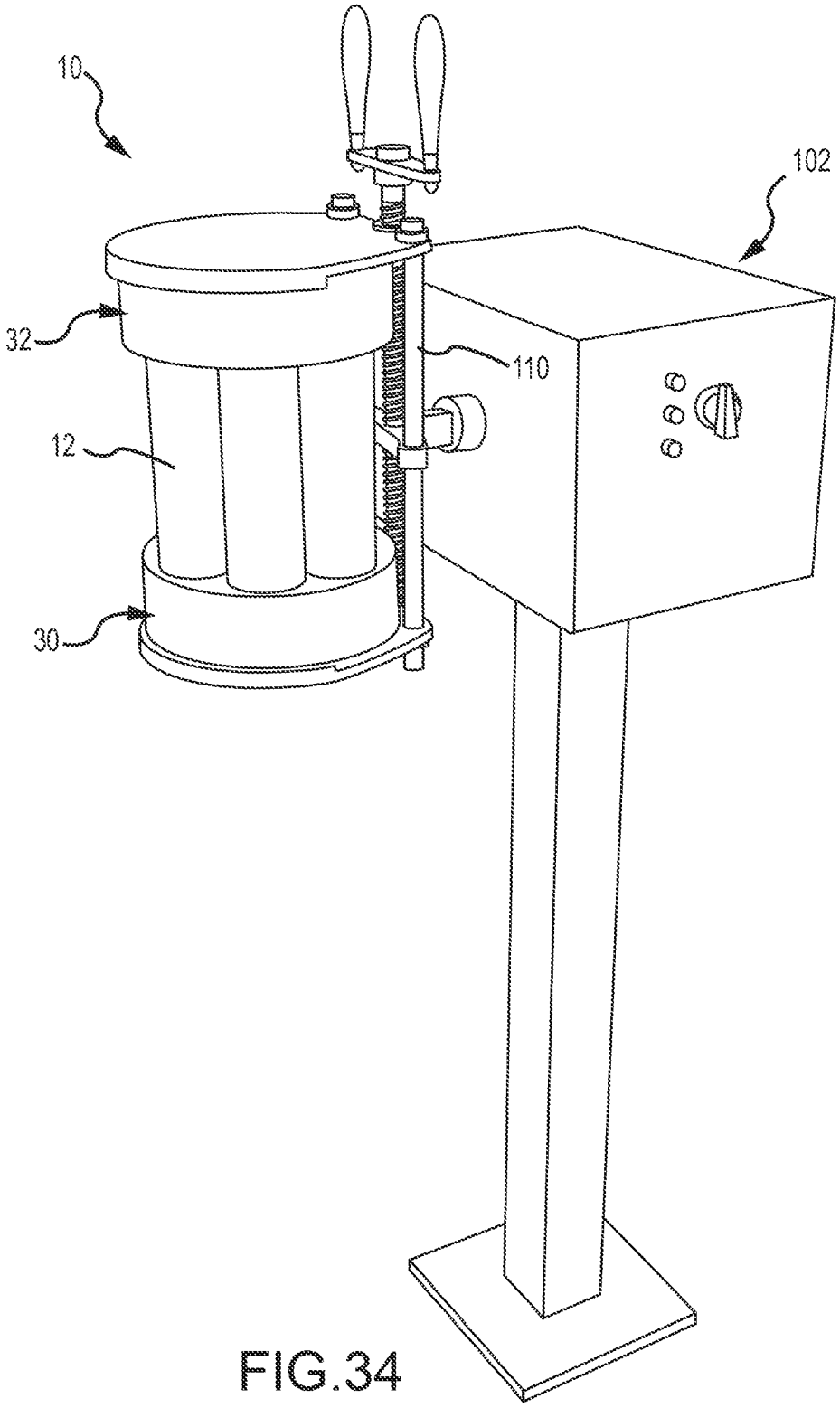
FIG. 34 depicts an isometric view of one embodiment of the system for providing custom colored sealing materials, as the same may be used with an agitating device, such as an oscillating paint shaker.
Figure 35:
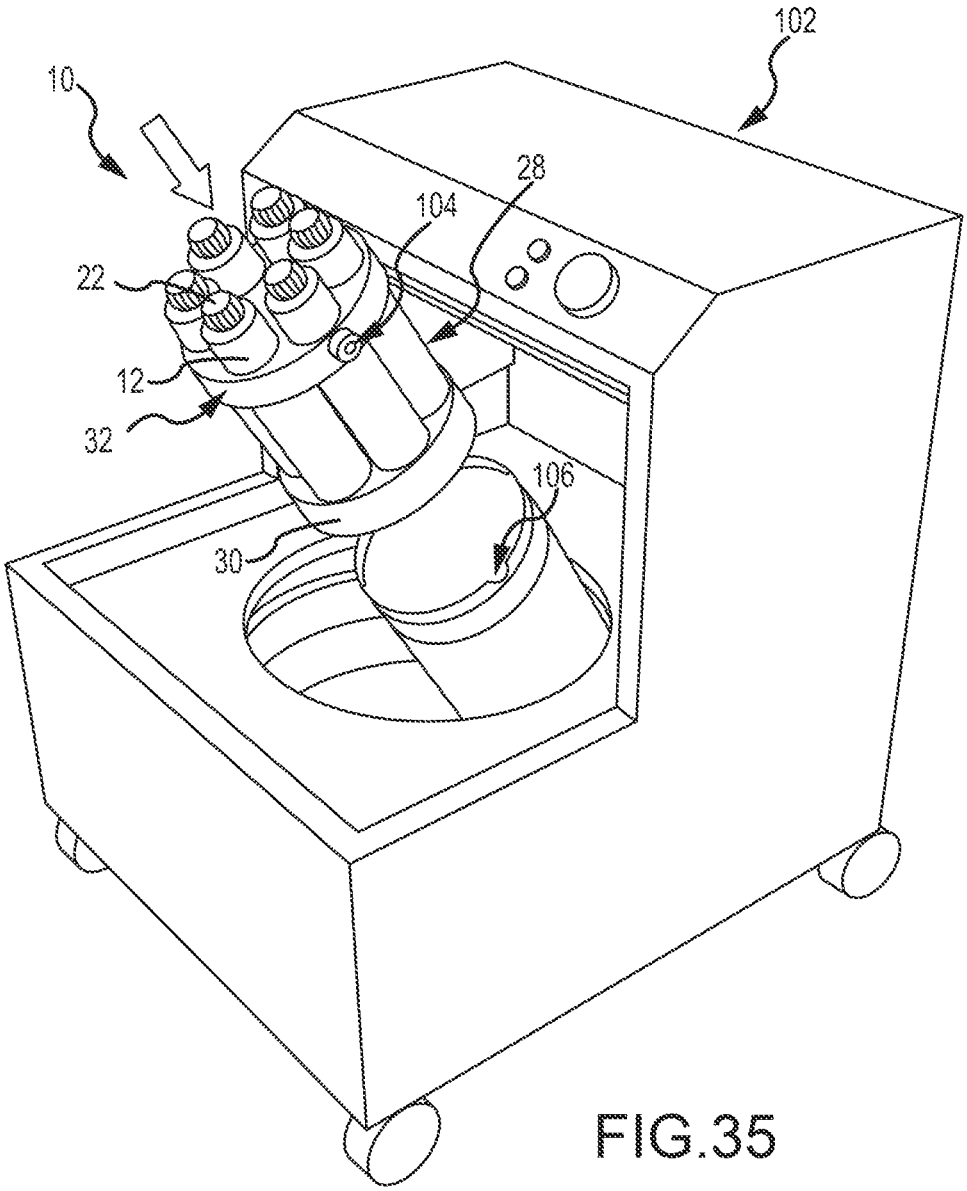
FIG. 35 depicts still another embodiment of the system for providing custom colored sealing materials, as the same may be used with another type of agitating device, such as a vortex paint mixer.
Figure 36:
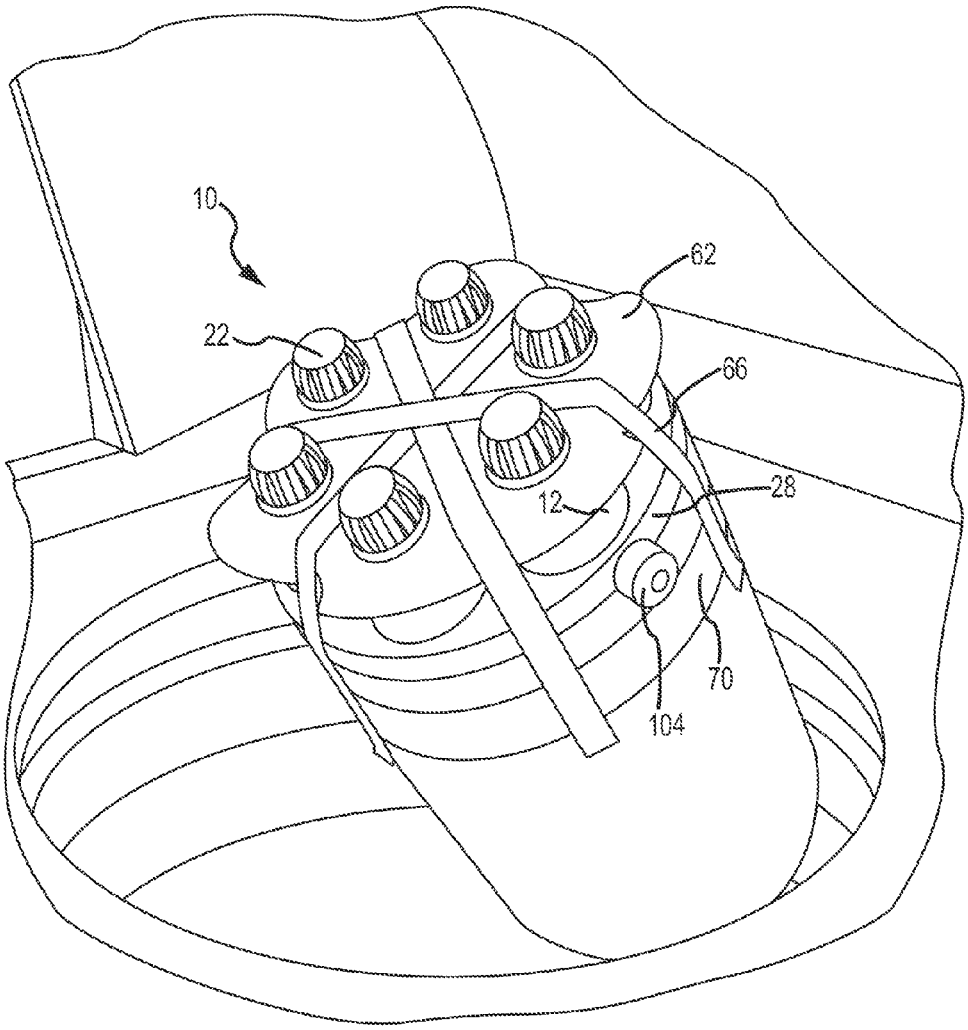
FIG. 36 depicts an isometric view of the system for providing custom colored sealing materials of FIG. 35 in an assembled, or mixing, orientation.

To assist in the step of agitating cartridge case 28, an agitating device 102 may be used. There are a variety of different paint mixing or paint shaking machines commonly used to mix paint containers in retail stores with different modes of machine operating motion. Examples of such agitating devices include oscillating shakers, vortex rotational mixers, gyroscopic rotational mixers, elliptical-orbit shakers, and the like. With reference to FIGS. 34-36, the various embodiments of the system 10 described previously may be employed for use with different types of agitating equipment. It will be apparent to those of skill in the art which of the aforedescribed embodiments of the system 10 will be best served in use with specific types of agitation equipment used in the art. For example, certain structural features within the system 10 will assist in adapting the system 10 for use with particular types of agitating equipment. For example, with reference to FIG. 35, one or more protrusions 104 may be provided to extend outwardly from the cartridge case 28, adjacent the second end portion 32. In particular, the protrusion 104 may be shaped to resemble a paint can handle ear. Such shapes are generally hemispherical in nature and engage notches 106 located in the upper edge portion of deep socket holders of various mixer baskets. With reference to FIGS. 9-11, the end cap 54 may be shaped to have at least two oppositely faced recesses 55 that extend into the sides of the end cap 54. In some embodiments, the recesses 55 will be generally hemispherical in shape to receive the retaining clamps commonly found on industry agitating devices. With reference to FIG. 36, hook and loop material 70 or other types of mechanical fasteners may be used to secure the straps 66 with a portion of the agitating device 102, such as the cartridge case receptacle, whereby the end cap 62 is positioned in a spaced-apart relationship with the second end portion of the cartridge case 28 in a secure position.

Although the system and methods of employing the same have been described in language that is specific to certain structures, materials, and methodological steps, it is to be understood that the invention defined in the appended claims is not necessarily limited to the specific structures, materials, and/or steps described. Rather, the specific aspects and steps are described as forms of implementing the claimed invention. Since many embodiments of the invention can be practiced without departing from the spirit and scope of the invention, the invention resides in the claims hereinafter appended. Unless otherwise indicated, all numbers or expressions, such as those expressing dimensions, physical characteristics, etc. used in the specification (other than the claims) are understood as modified in all instances by the term "approximately." At the very least, and not as an attempt to limit the application of the doctrine of equivalents to the claims, each numerical parameter recited in the specification or claims which is modified by the term "approximately" should at least be construed in light of the number of recited significant digits and by applying ordinary rounding techniques. Moreover, all ranges disclosed herein are to be understood to encompass and provide support for claims that recite any and all subranges or any and all individual values subsumed therein. For example, a stated range of 1 to 10 should be considered to include and provide support for claims that recite any and all subranges or individual values that are between and/or inclusive of the minimum value of 1 and the maximum value of 10; that is, all subranges beginning with a minimum value of 1 or more and ending with a maximum value of 10 or less (e.g., 5.5 to 10, 2.34 to 3.56, and so forth) or any values from 1 to 10 (e.g., 3, 5.8, 9.9994, and so forth).

What is claimed is:

1. A system for providing custom colored sealant; the system comprising:

at least one dispensing cartridge, having a first end portion with an opening that extends into an open interior compartment of the at least one dispensing cartridge and a cartridge cap that removably secures with the first end of the dispensing cartridge to selectively cover the opening;

a quantity of sealant base solution disposed within the interior compartment of the at least one dispensing cartridge;

a cartridge case having a plurality of cartridge receptacles that are placed in a co-planar, linearly spaced-apart orientation with one another; the cartridge case being divided along a plane that extends along the long axes of the plurality of cartridge receptacles, whereby the cartridge case may be divided into at least a first end portion and a second end portion to expose lengths of the plurality of cartridge receptacles for loading and unloading dispensing cartridges therefrom;

the first and second end portions of the cartridge case are coupled with one another by planar sidewalls; and optionally, a quantity of sealant thickener disposed within the interior compartment of the at least one dispensing cartridge and mixed with the quantity of sealant base solution.

2. The system of claim 1 wherein the cartridge case has a rectangular cross-section.

3. The system of claim 1 wherein the at least two parts of the cartridge case are secured to one another by at least one locking pin that engages at least one locking pin recess formed in the cartridge case.

4. The system of claim 1 wherein the cartridge case is divided along two planes that extend in a parallel, spaced apart relationship with one another, along long axes of two separate levels of a plurality of cartridge receptacles, whereby the cartridge case may be divided into at least three parts to expose lengths of the plurality of cartridge receptacles for loading and unloading dispensing cartridges therefrom.

5. The system of claim 4 wherein the at least three parts of the cartridge case are secured to one another by a plurality of locking pins that engage locking pin recesses formed in the cartridge case.

6. The system of claim 1 wherein there are at least seven dispensing cartridges and at least seven cartridge receptacles.

7. The system of claim 1 wherein the plurality of cartridge receptacles are defined by at least one receptacle sidewall that extends between the first and second end portions of the cartridge case.

8. The system of claim 1 wherein the plurality of cartridge receptacles are formed, at least in part, with generally rectangular cross-sections, and tapered volumes over lengths of the plurality of cartridge receptacles, and the at least one dispensing cartridge is formed with a complimentary rectangular cross-section, such that the at least one dispensing cartridge may fit within at least one of the plurality of cartridge receptacles.

9. The system of claim 1 wherein the plurality of cartridge receptacles are formed with generally circular cross-sections and the at least one dispensing cartridge is formed with a complimentary circular cross-section, such that the at least one dispensing cartridge may fit within at least one of the plurality of cartridge receptacles.

10. The system of claim 1 wherein the quantity of sealant base solution has a viscosity of between or equal to 50 to 100,000 centipoise.

11. The system of claim 1 further optionally comprising a quantity of a coloring agent disposed within the interior compartment of the at least one dispensing cartridge and mixed with the quantity of sealant base solution and quantity of sealant thickener.

* * * * *